US008325093B2

(12) United States Patent
Holland et al.

(10) Patent No.: US 8,325,093 B2
(45) Date of Patent: Dec. 4, 2012

(54) PLANAR ULTRAWIDEBAND MODULAR ANTENNA ARRAY

(75) Inventors: Steven S. Holland, Amherst, MA (US); Marinos N. Vouvakis, Amherst, MA (US)

(73) Assignee: University of Massachusetts, Boston, MA (US)

( * ) Notice: Subject to any disclaimer, the term of this patent is extended or adjusted under 35 U.S.C. 154(b) by 121 days.

(21) Appl. No.: 12/848,301

(22) Filed: Aug. 2, 2010

(65) Prior Publication Data

US 2012/0146869 A1 Jun. 14, 2012

Related U.S. Application Data

(60) Provisional application No. 61/230,271, filed on Jul. 31, 2009.

(51) Int. Cl.
*H01Q 1/38* (2006.01)

(52) U.S. Cl. ..... 343/700 MS

(58) Field of Classification Search ..... 343/700 MS, 343/702, 846, 829–830, 848, 853
See application file for complete search history.

(56) References Cited

U.S. PATENT DOCUMENTS

| | | | | |
|---|---|---|---|---|
| 5,706,015 | A * | 1/1998 | Chen et al. | 343/700 MS |
| 6,369,770 | B1 * | 4/2002 | Gothard et al. | 343/794 |
| 6,396,456 | B1 * | 5/2002 | Chiang et al. | 343/795 |
| 6,483,464 | B2 * | 11/2002 | Rawnick et al. | 343/700 MS |
| 6,639,558 | B2 * | 10/2003 | Kellerman et al. | 343/700 MS |
| 7,528,780 | B2 * | 5/2009 | Thiam et al. | 343/700 MS |

* cited by examiner

*Primary Examiner* — Huedung Mancuso
(74) *Attorney, Agent, or Firm* — Brian M. Dingman; Mirick, O'Connell, DeMallie & Lougee, LLP

(57) ABSTRACT

A planar ultrawideband modular antenna for connection to a feed network. The antenna has a ground plane, and an array of antenna elements spaced from the ground plane, each antenna element comprising a pair of arms. A first fed arm is electrically coupled to the feed network. The grounded arm is directly electrically coupled to the ground plane. There are one or more conductors such as conductive vias electrically connecting the fed arm to the ground plane, and optionally there are one or more additional conductors electrically connecting the grounded arm to the ground plane.

29 Claims, 28 Drawing Sheets

PLANAR ULTRAWIDEBAND MODULAR ANTENNA ARRAY

CROSS-REFERENCE TO RELATED APPLICATION

This application claims priority of Provisional Patent Application Ser. No. 61/230,271 filed on Jul. 31, 2009, the entire contents of which are incorporated herein by reference.

STATEMENT REGARDING FEDERALLY SPONSORED RESEARCH

This invention was made with government support under grant number PG #11320000000008, contract number N00173-08-1-G033, awarded by the Naval Research Laboratory. The government has certain rights in this invention.

FIELD

This invention relates to antennas, antenna arrays, UWB wireless communication systems, RADARs, and multifunctional systems.

BACKGROUND

Ultrawideband (UWB) phased arrays are desirable for use in high-throughput wireless communication systems, such as cellular and satellite systems, as well as radar, electromagnetic countermeasure, and multifunctional (communications/sensing) systems. Currently, the dominant UWB array technologies require elaborate vertical integration, are non-planar and often require 3D machined parts (feed organizer) along with external baluns or hybrid circuits. Vertical integration, 3D machining and non-modular assembly are particularly problematic in phased array technologies because a large number (100-7000) of elements must be integrated together, leading to very high recurring costs. In addition, these arrays face challenges when conformal mounting is required. Also, fabrication at millimeter-wave frequencies is intractable because the required manufacturing and integration technologies do not scale to smaller sizes without significant cost penalties. For that reason these arrays are prohibitive for commercial applications (which require very low recurrent fabrication costs) and are typically used at the lower frequency bands (L, C, X bands) for defense applications. A fully planar, modular UWB array that can be scaled to higher frequencies could have significant impact on current and future commercial as well as defense systems.

Microstrip patch arrays, while fully planar and easy to fabricate, offer limited bandwidths. A typical microstrip antenna in isolation, fed by a microstrip line or a probe, has less than 5% fractional bandwidth, while fractional bandwidth up to 50% have been reported using aperture feeding, stacked patches, thick substrates, L-shaped feeds, or other broadbanding techniques. When used in arrays, designs have achieved moderate bandwidths, such as Edimo, who reported a 16% fractional bandwidth using an array of aperture fed stacked patches (M. Edimo, P. Rigoland, and C. Tenet, "Wideband dual polarized aperture coupled stacked patch antenna array operating in C-band", *Electronics Letters, IEEE*, vol. 30, pp. 1196-1197, July 1994.), while Lau has reported 20% fractional bandwidth using L-probe fed stacked patches (Lau, K. L.; Luk, K. M., "A Wideband Dual-Polarized L-Probe Stacked Patch Antenna Array," *Antennas and Wireless Propagation Letters, IEEE*, vol. 6, pp. 529-532, 2007.). While these bandwidths are high compared to that of a typical microstrip patch antenna, these planar apertures do not offer large enough bandwidths for multifunctional UWB applications.

A second quasi-planar technology that can offer moderate bandwidths are dielectric resonator arrays (DRA), which are comprised of arbitrarily shaped 3D dielectric slabs attached to a substrate. These resonators are fed with microstrip lines, slots, or probes, similar to patch arrays. Although not fully planar, DRAs are simple to fabricate and have low profile. Arrays have been designed with bandwidths on the order of a few percent, such as an array presented by Oliver ("Broadband Circularly Polarized Dielectric Resonator Antenna" U.S. Pat. No. 5,940,036) which has a fractional bandwidth of 5%, while others have reported fractional bandwidths up to 21% ("Dielectric Resonator Antenna With Wide Bandwidth" U.S. Pat. No. 5,453,754). As with the microstrip patch arrays, DRAs offer simple fabrication and feeding, but do not offer the high bandwidths appropriate for UWB applications.

The first quasi-planar array that offers UWB operation is the Current Sheet Antenna (CSA). This array is based on Wheeler's current sheet concept (H. Wheeler, "Simple relations derived from a phased-array antenna made of an infinite current sheet," *IEEE Transactions on Antennas and Propagation*, vol. 13, no. 4, pp. 506-514, July 1965). Ben Munk realized Wheeler's current sheet with a periodic array of closely packed horizontal dipoles, placed $\lambda/4$ above an infinite ground plane. The capacitance of the short dipoles is counteracted by the inductance of the ground plane, leading to large bandwidths. A practical implementation of this array concept was disclosed by R. Taylor and B. Munk ("Wideband Phased Array Antenna and Associated Methods", U.S. Pat. No. 6,512,487 B1), which is comprised of periodically placed crossed dipoles with coincident-phase center feeds and with large interdigitated capacitors between neighboring dipoles. The elements are placed $\lambda/4$ (at midband) distance away from the ground plane, and, since dipoles are balanced structures, an external balun must be attached at each port to connect each element to standard (unbalanced) transmission lines. The array allows for single or dual polarization and has high efficiency, planar aperture layer, good scan performance, and a reported bandwidth up to 9:1 (160% fractional bandwidth). However, while the element layer with elements 106 and 107 is planar, the feed structure consists of a 3D metallic structure 127, see FIGS. 1B and C.

Feed structure 127 is called the "feed organizer"; two different style feed organizers have been developed for the CSA array ("Patch Dipole Array Antenna and Associated Methods", U.S. Pat. No. 6,307,510, and "Patch Dipole Array Antenna Including A Feed Line Organizer Body And Related Methods", U.S. Pat. No. 6,483,464 B2). The feed organizer isolates the four (assuming dual-pol) vertical balanced feed lines (e.g., lines 103 and 104), provides a ground reference (ground plane labeled 101), and suppresses a common mode that would otherwise develop if the feed lines were unshielded. The use of this elaborate feed device is critical for the CSA operation, since the development of common mode reduces the array bandwidth significantly. In addition to the complexity and cost of 3D metal feed organizers, the balanced feed lines require an external balun (128, shown in FIG. 1B) in order to interface with common unbalanced microwave transmission lines. This external balun in the feed network adds complexity and size to the feed network.

The CSA has been implemented in various additional forms. One implementation uses square patch elements densely arranged to achieve high capacitive coupling between elements and obtains a 2:1 bandwidth with scanning out to $\theta=45°$ and return loss $<-10$ dB ("Patch Dipole Array Antenna and Associated Methods", U.S. Pat. No. 6,307,510). Another CSA design uses two stacked layers of CSAs operating at different bands to form large bandwidth arrays, such as those disclosed by Rawnick (U.S. Pat. No. 6,552,687 B1 and U.S. Pat. No. 6,771,221 B1), and by Croswell (U.S. Pat. No. 6,876,336 B1). Rawnick also disclosed a modular implementation that divided the array aperture along the gap between neighboring elements, forming tiles containing two orthogonal dipole elements ("Phased Array Antenna Formed As Coupled Dipole Array Segments" U.S. Pat. No. 7,463,210 B2). This arrangement removes the possibility of interdigitated capacitors between dipole elements; instead a set of metal plates are arranged across the boundary of neighboring tiles to achieve the required high capacitive coupling between the same polarization elements.

The second quasi-planar aperture topology capable of delivering UWB operation is the Fragmented Aperture Antenna (FAA), ("Fragmented aperture antennas and broadband antenna ground planes", U.S. Pat. No. 6,323,809 B1 Maloney). The array is comprised of electrically connected, balanced metallic elements with complex shapes generated via numerical optimization techniques. To optimize performance, the element shapes are derived using discrete metal squares as building blocks, which are then arranged using genetic algorithms to optimize the bandwidth. As a result, the array achieves very wideband operation, with reported bandwidths up to 33:1 (fractional bandwidth of 188%) in dual or single polarized configurations, where the array has coincident phase center feeding when dual polarized. As with the CSA, the FAA requires a 3D metal feed organizer, external baluns and impedance transformers. A more serious drawback arises when unidirectional radiation is required from the FAA. When the array is backed by a ground plane, a series of catastrophic resonances appear in the band of operation. To remedy these resonances the FAA uses circuit analog absorbers or Jaumann screens. These structures are lossy and dramatically reduce the efficiency and power handling capability of the array, while in the receive mode they increase the antenna noise figure. A 1-2.8 dB reduction in gain is typical, indicating that in some cases nearly half of the input power is lost to heat in the resistive cards.

It is clear from the above discussion that only balanced (dipole-type) structures have thus far succeeded in offering UWB array operation. Since all balanced structures require an external balun or hybrids to connect to standard RF interfaces, the balun is a major component of the design. Over the years, much work has been done on integrated balun implementations for dipole elements. For example, U.S. Pat. No. 3,747,114 issued to Shyhalla shows a dipole array with baluns printed on the backplane, with the balun consisting of phase delay lines between the balanced feed pins of the dipole elements. Another example of an integrated balun is disclosed in U.S. Pat. No. 3,845,490 issued to Manwarren et al, which shows a stripline dipole structure fed by an "L" shaped transmission line embedded between the dipole layers. In U.S. Pat. No. 4,825,220, Edward et al demonstrates a "J" shaped microstrip line (also known as a Marchand balun) feeding a microstrip dipole structure that achieves 40% fractional bandwidth with VSWR <2. U.S. Pat. No. 5,892,486 issued to Cook et al also incorporated a "J" shaped microstrip line feeding a microstrip dipole where the "J" shaped balun extended above the dipoles. Pickles developed coincident phase center dipole arrays fed with double Marchand baluns that demonstrated a fractional bandwidth of 100% (W. R. Pickles and W. M. Dorsey, "Proposed Coincident Phase Center Orthogonal Dipoles," *Antenna Applications Symposium*, pp. 106-124, 18-20, Sep. 2007. Monticello, Ill.). All of these solutions are relatively narrowband and require vertical integration (at least for the feeding section).

In the above discussion, it is clear that fully planar, unbalanced structures that can be directly fed by standard RF interfaces are narrowband, e.g. patch arrays and DRA. On the other hand, UWB arrays such as CSA or FAA are not fully planar (only the aperture layer is planar, with feed organizers or 3D machined parts that require non-planar integration and assembly) and require external baluns or hybrids. Any attempt to integrate baluns into planar arrays has yielded low bandwidth and must be vertically integrated. If low-cost, scalable UWB arrays are to be a reality, then a fully planar UWB array with integrated balun is necessary.

SUMMARY

A fully planar, modular UWB array, and the antennas and antenna cells that make up the array. An embodiment of the array comprises a planar/conformal layer of short horizontal dipole-like elements fed by simple conductors, such as non-blind plated vias, or pins; one via or pin connects the active dipole arm to the center conductor of a coaxial or other standard RF interface or connector, while a second via or pin connects the other dipole arm directly to the ground. Also, one or both element arms are grounded, for example through an extra plated via which constitutes an integrated balun structure, allowing the elements to be fed directly at the ground plane from a standard unbalanced RF interface without the development of a common mode. The array elements are preferably arranged in a square periodic lattice and are dual-polarized. The dual-polarization is achieved through a dual-offset arrangement in each periodic unit cell, where the centers of horizontal and the vertical polarized elements are offset by a distance from the center of the periodic unit cell. The dielectric placed between the element layer and the ground plane, is preferably of low permittivity and PTFE type, in order to be able to plate vias through it. To circumvent this, a regular PTFE can be used that is perforated with holes (that may be round) in the region between the orthogonal layer arms. This allows the elimination of otherwise catastrophic surface waves under scanning. Underneath each unit cell a planar matching network layer can be used to improve the level of matching. The matching network can also be printed with standard microwave fabrication techniques and does not require direct electrical connection to the array ground or vias, avoiding the use of blind vias, thus making fabrication and assembly easier. Due to this arrangement, the array is lightweight, low profile, modular, and suitable for single and dual polarized configurations, while achieving bandwidths up to 5.5:1 (fractional bandwidth of 140%). The completely planar topology of the array enables standard low cost microwave and millimeter-wave circuit fabrication for both the array and the vertical feed lines. The array has demonstrated stable impedance with scan and polarization.

The inventive Planar Ultrawideband Modular Array (PUMA) operates over a wide bandwidth in an array environment. The elements can be used in both single and dual polarized dual-offset array configurations, can have completely planar and modular fabrication, and can directly interface with standard feed architectures since the array incorporates a novel balun structure. The array is simple to fabricate using standard microwave and millimeter-wave fabrication techniques, is lightweight, conformal and low profile.

The PUMA has demonstrated up to 5.5:1 bandwidth at broadside with Voltage Standing Wave Ratio (VSWR) <2.3 and very good impedance stability versus scan angle and polarization, with only moderate increase in VSWR when scanned out to θ=45°. This allows the elements to be used in an array capable of very wide scan.

The PUMA is a truly planar wideband array, where both the aperture and its feeding can be fabricated and assembled with only simple planar microwave and millimeter-wave circuit fabrication techniques. The array allows for the following:

- Completely planar construction (no 3D metal structures required)
- No external balun required, can connect directly to standard RF interfaces
- Simple, low cost standard planar microwave or millimeter circuit fabrication
- Conformal (using RF-on-Flex)
- Modular construction
- Low Profile (total height approximately λ/3 at midband)
- UWB performance of 5.5:1 (140% fractional bandwidth)
- Good scanning performance
- Good polarization diversity There are many different types of planar array apertures, such as microstrip patch arrays, slot arrays, Current Sheet Antenna (CSA), and the Fragmented Aperture Antenna (FAA), but of these only the CSA and FAA have truly wideband performance. Although the CSA and FAA have planar printed elements at the aperture, they require complex 3D metal structures (feed organizers) between the ground plane and the element layer and also external baluns or hybrids in order to achieve wideband performance. The 3D metal feed organizers require complex machining, increase weight, and make assembly of the array difficult, especially at high frequencies. The external baluns or hybrids add complexity and expense to the feed network.

The PUMA eliminates the need of such "feed organizers" and external baluns or hybrids. This allows the array to be fabricated and assembled at low cost, and it allows the elements to be directly connected to standard unbalanced RF interfaces. This performance is achieved with the addition of one or two extra metallic vias per element; the vias connect the fed arm, or both arms of the element, to the ground plane. While only requiring one or two extra metallic vias per element, this topology suppresses the catastrophic common mode that would otherwise develop on the feed line if the metallic vias were not used—this is the same common mode that the CSA and FAA suppress using complex 3D metal feed organizers and external baluns or hybrids.

PUMAs have been designed to achieve bandwidths of up to 5.1:1 in the dual polarized configuration. These designs operate in the frequency range of 1-5.5 GHz, and can be manufactured using stock dielectric thicknesses and relative permittivities and by employing chemical etching and plating fabrication technology The dual polarized array performs well for both slant linear and circular polarization, and has good scan performance out to 45°. This performance is achieved while retaining a completely planar construction that allows for large UWB arrays to be fabricated inexpensively.

This invention features a planar ultrawideband modular antenna for connection to a feed network, comprising a ground plane, one or more antenna elements spaced from the ground plane, each antenna element comprising a pair of arms, a first fed arm electrically coupled to the feed network and a second grounded arm directly electrically coupled to the ground plane. There are one or more first conductors electrically connecting the fed arm to the ground plane, and optionally one or more second conductors electrically connecting the grounded arm to the ground plane.

The arms may comprise traces on the surface of a dielectric. The first and second conductors may comprise vias passing through the dielectric. Vias on the first arm are useful to tune out of the band the common mode, while vias on the second arm are optional, and are used to control the matching level and help shift the common mode further out of the band. The arms may be co-planar. The arms may lie along a single longitudinal axis. An antenna cell may comprise two such antennas, in which the longitudinal axes of the arms of the two antennas are orthogonal, and offset by a horizontal and vertical distance, respectively, from the center of the unit. A planar ultrawideband modular array antenna may comprise a plurality of such antenna cells.

The planar ultrawideband modular antenna may further comprise an RF feed comprising a first feed conductor that passes through or to the ground plane without touching it and is connected to the first arm, and a second feed conductor connected between the ground plane and the second arm. The connections of the feed conductors may be at feed points that are at or proximate one end of the arms. The first and second conductors may be located between the feed points and the other ends of the arms. The arms may have a substantially rectangular shape proximate the feed points. The arms may have a substantially diamond shape at the other ends. The antenna may further comprise capacitances located between adjacent arms of different elements. The capacitances may comprise overlying planar conductors that are vertically separated, or may comprise interdigitated fingers that extend from adjacent arm portions.

The arms of the two antennas may be co-planar. The arms of the two antennas may be located in different planes, and form a parallel plate capacitor at the ends of two orthogonal polarized elements. The two different element layers can be separated by a small vertical distance by a thick dielectric that can be the bonding layer used to bond the bottom and top dielectrics in the structure. The antenna unit may further comprise one or more planar metallic elements spaced from the arms to improve capacitive coupling between orthogonally polarized arms. The antenna elements may be arranged in a dual-offset configuration. In addition to the bottom dielectric layer that should be of low permittivity, the antenna may further comprise one or more dielectric layers on top of the elements. The bottom dielectric and optionally the top ones may be perforated with air holes to improve scan performance. The air holes may be cylindrical. The total thickness of the array may be approximately equal to one-third of the mid-band free space wavelength of the feed.

Further featured is a planar ultrawideband modular array antenna for connection to a feed network, comprising a plurality of antenna cells, each cell comprising two antennas, each antenna comprising a ground plane, an antenna element spaced from the ground plane, the antenna element comprising a pair of co-planar arms comprising traces on the surface of a dielectric, in which the arms of an element lie along a single longitudinal axis, and in which the longitudinal axes of the arms of the two antennas are orthogonal, in which the first arm is electrically coupled to the feed network and the second arm is directly electrically coupled to the ground plane, wherein the elements of the plurality of cells are arranged in a dual offset configuration. There are one or more first conductive vias through the dielectric that electrically connect the first arm to the ground plane. Optionally there are one or more second conductive vias through the dielectric that electrically connect the second arm to the ground plane. There is an unbalanced RF feed to the arms comprising a first feed conductor that passes to or through the ground plane without touching it and is connected to the first arm, and a second feed conductor connected between the ground plane and the second arm, in which the connections of the feed conductors is at feed points that are at or proximate one end of the arms. The first and second conductors are located between the feed points and the other ends of the arms. The arms have a substantially rectangular shape proximate the feed points. The antenna further comprises capacitances located between adjacent arms of different elements. The capacitances may be accomplished with overlying planar portions of the arms that are vertically offset. The thickness of the antenna is approximately equal to one-third of the mid-band free space wavelength of the feed.

The fed arm may be coupled to the feed network by a feed line that passes to or through the ground plane without touching it and is connected to the fed arm at a feed point, and a grounding conductor may be connected between the ground plane and the grounded arm at a grounding point. The feed point and the grounding point are preferably at or proximate one end of the arms. The first conductor is preferably located between the feed point and the other end of the fed arm. The arms preferably have the same shape, the shape being substantially rectangular proximate the feed and grounding points. The substantially rectangular shape may be linearly tapered, and most narrow proximate the feed and grounding points. The ends of the arms most distant from the feed and grounding points may define a narrowing linear taper. There may be a capacitive region at the ends of the arms farthest from the feed and grounding points. The capacitive region may comprise two rectangular conductors one connected perpendicularly to each side of the narrowing linear taper.

The feed line may be coupled to a matching network that comprises a feed capacitor. The feed capacitor may comprise parallel conductive plates. The matching network may further comprise a microstrip line quarter wavelength transformer connected to the feed capacitor. One of the plates of the feed capacitor and the microstrip line may bee located in a plane that is parallel to the ground plane. The arms may be separated from the ground plane by one or more layers of dielectric, and one or more such dielectric layers may be perforated through their thickness. The arms may radiate from a central region and at the central region together define overlapping parallel plate capacitors.

Featured in another embodiment is a planar ultrawideband modular array antenna cell for connection to a feed network, comprising a ground plane and two antennas, each antenna comprising a fed arm and a grounded arm that are co-planar, the arms comprising traces on a surface of a dielectric, in which the arms of each antenna lie along a single longitudinal axis, and in which the longitudinal axes of the arms of the two antennas are orthogonal and lie in parallel planes, in which the fed arm of each antenna is capacitively coupled to the feed network and the grounded arm of each antenna is directly electrically coupled to the ground plane. There are one or more conductive vias through the dielectric that electrically connect the fed arm to the ground plane. The arms are arranged in a dual offset configuration. There are one or more dielectric layers on top of the elements. The thickness of the array is approximately equal to one-third of the mid-band free space wavelength of the feed. The fed arm is coupled to the feed network by a feed line that passes to or through the ground plane without touching it and is connected to the fed arm at a feed point, and a grounding conductor is connected between the ground plane and the grounded arm at a grounding point, in which the feed point and the grounding point are at or proximate one end of the arms. The conductive via is located between the feed point and the other end of the fed arm. The arms have the same shape, the shape being substantially rectangular proximate the feed and grounding points and further comprise a capacitive region at the ends of the arms furthest from the feed and grounding points, the capacitive region defined by parallel conductive plates. The feed line is coupled to a matching network that comprises a feed capacitor that comprises parallel conductive plates, in which the matching network further comprises a microstrip line quarter wavelength transformer connected to the feed capacitor, and in which one of the plates of the feed capacitor and the microstrip line are located in a plane that is parallel to the ground plane. The arms are separated from the ground plane by one or more layers of dielectric, one or more of which are perforated through their thickness. Also featured is an antenna made up of a number of such cells.

DETAILED DESCRIPTION OF EMBODIMENTS

This invention accomplishes a completely planar phased array that allows the array elements and feeding structure to be embedded between and within dielectric layers, allowing the array to be fabricated using standard microwave and millimeter-wave circuit fabrication techniques. The elements consist of pairs of horizontal arms—two per element—spaced from a ground plane that is typically approximately one quarter wavelength away at the middle of the operating band. The thickness of the entire array is on the order of one third of a wavelength at midband, making the array low profile. The array elements can be arranged in either single or dual polarized arrays, for example in a dual-offset (egg-crate) lattice, as shown in FIGS. 3A and 3B, respectively.

Figure 1A:
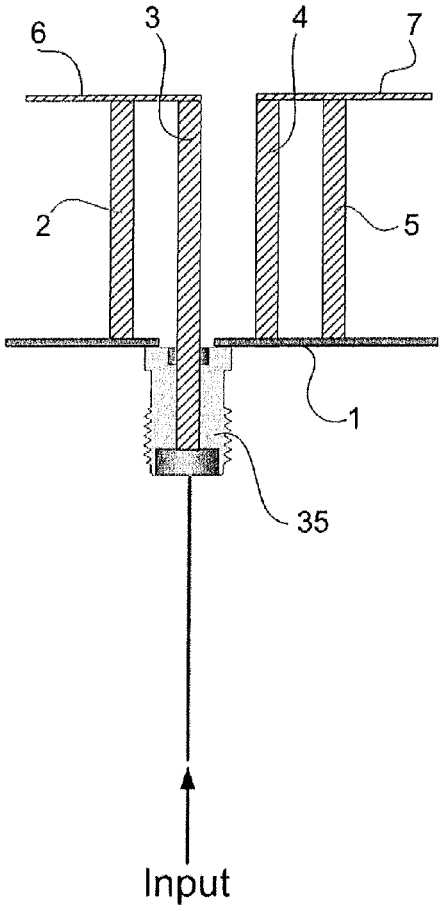
FIG. 1—Simplified schematic cross sections illustrating the construction and manner in which the signals are fed for: (A) one embodiment of the PUMA; (B) traditional (prior art) dipole arrays with a feed organizer; and (C) a cross section of the feed organizer of (B), taken along line (C).
Figure 1B:
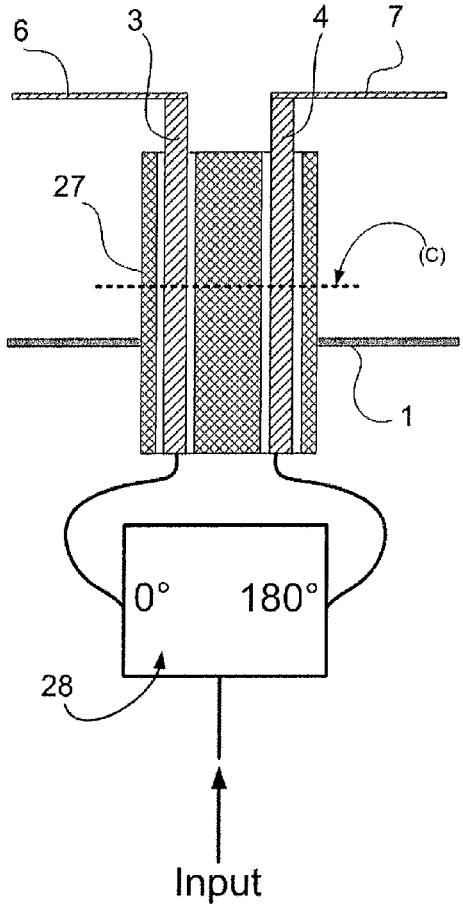
Figure 1(B) Prior Art
Figure 1C:
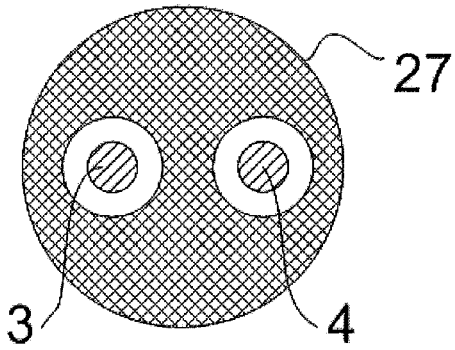
Figure 1(C) Prior Art

FIG. 1A shows array 50. Array 50 comprises co-planar arms 6 and 7 that are spaced from ground plane 1 and fed through lines 3 and 4, respectively. Lines 3 and 4 are fed via coaxial connector 31, or a coaxial transmission line. Conductors 2 and 5 are spaced from conductors 3 and 4, respectively, and connect elements 6 and 7 to ground. Conductor 5 is optional and can be used to tune the performance.

Figure 3:
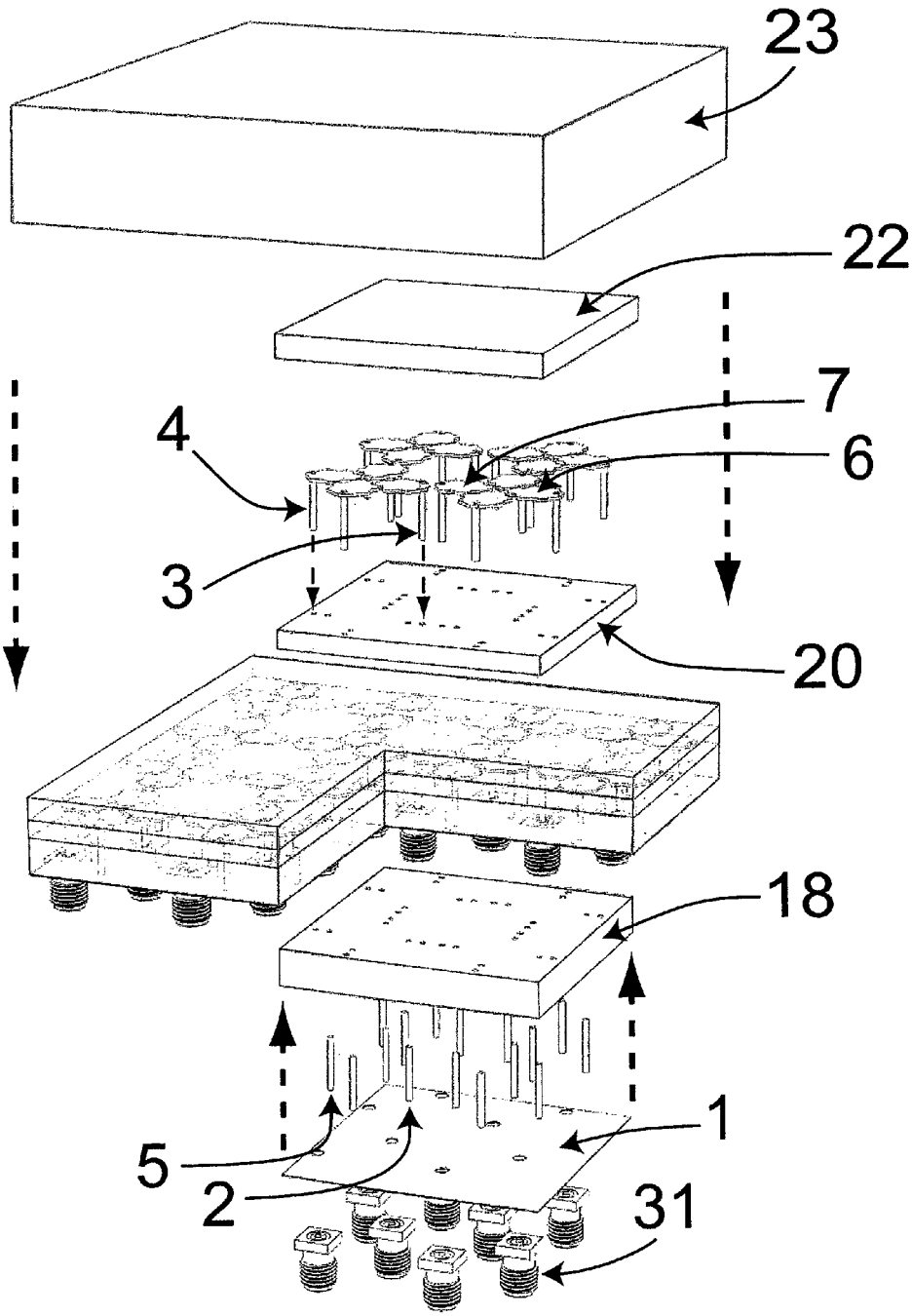
FIG. 3—A partial, exploded view of an embodiment of the PUMA, showing an assembled 4×4×2 tile and an exploded view of the parts of a 2×2×2 tile.

A 3D view illustrating a basic embodiment of the PUMA is depicted in FIG. 3, which shows the assembled dielectric layer stack with the various metallizations as well as an exploded 3D view that suggests a modular tile-based planar fabrication and assembly. The elements for each polarization consist of pairs of metallic arms oriented horizontally and are printed on the top of a two layer grounded dielectric of approximately one quarter wavelength thickness at the middle of the frequency band. These elements are arranged periodically in a rectangular grid. The periodicity of this grid is typically of the order of $\lambda/4$ ($\lambda$ at midband), which implies that the element arms must be electrically short, and thus capacitive in nature.

Figure 4A:
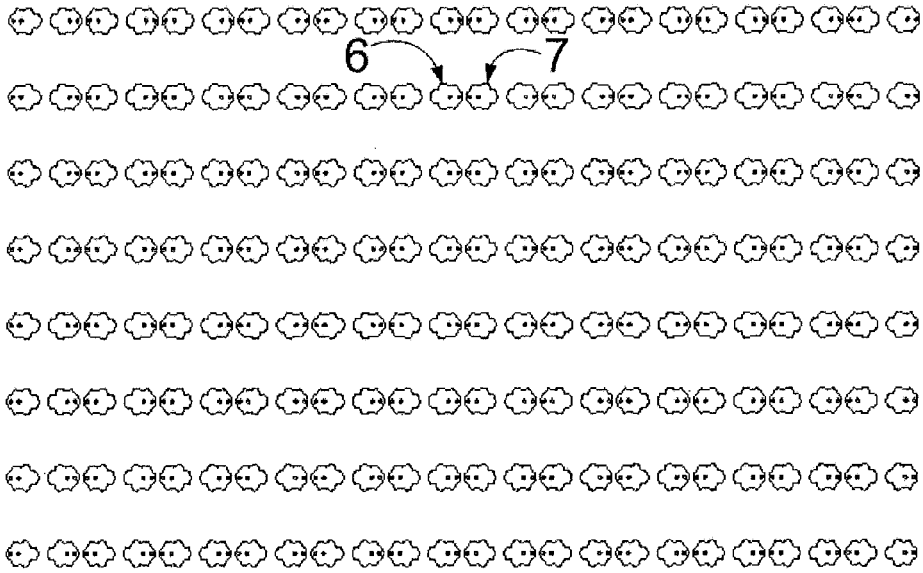
FIG. 4—Top views of a PUMA metallization layer (A) single polarized configuration, and (B) dual polarized dual offset configuration.
Figure 4B:
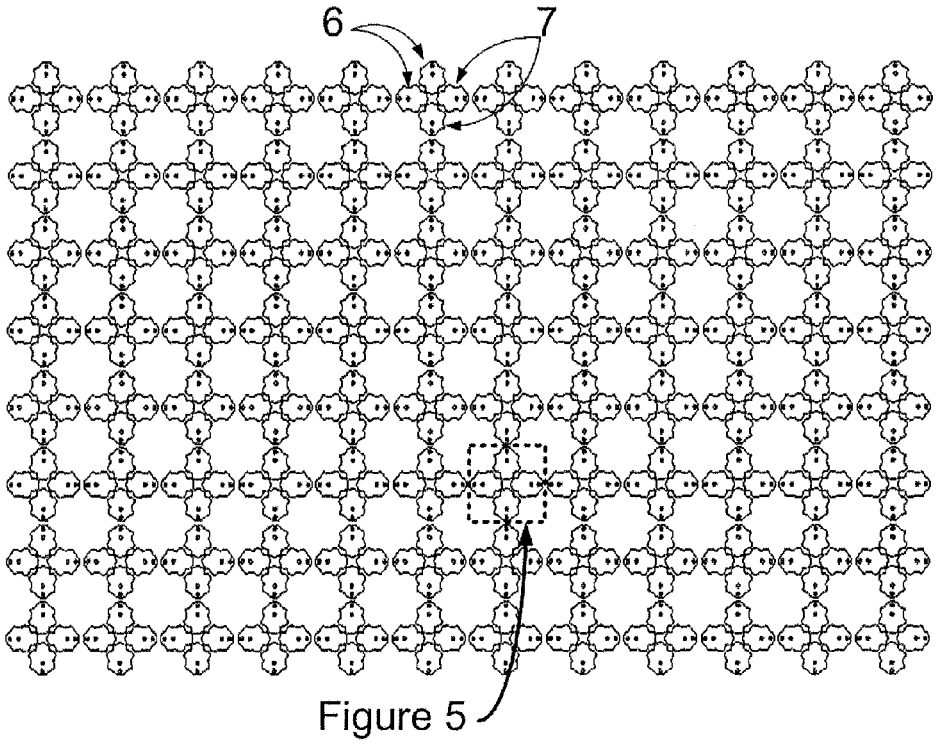

A single polarized arrangement of the PUMA is shown in a top view in FIG. 4A. The dual-polarized version is arranged in a dual offset (egg-crate) fashion as shown in FIG. 4B. The dual offset arrangement is important for the modularity of the PUMA because it allows for a gap between element arms around the feeding region (see conductors 3 and 4 in FIG. 2) as demonstrated in the dashed region of FIG. 4B. The gap is used to place module cut planes between neighboring cells that enable the modular construction and assembly of such tiles. The shape of the arms can take many forms (shown as arbitrary shapes, FIG. 5)—from a basic rectangle to an interdigitated diamond shape—and together the pair of arms comprises a balanced structure fed differentially. While this structure would normally require a balanced feed line and an external balun in order to operate properly over a wide bandwidth, the present invention uses a two lead, unbalanced feed line (typically in the form of plated vias) to excite the two arms, but with an integrated balun. One conductor of the feed line is excited with a common unbalanced transmission line structure below the ground plane (could be microstrip, stripline, coaxial cable, etc), that is extended up through a clearance hole in the ground. The other conductor of the unbalanced feed line is connected directly to the ground plane and through the second via extends up to the other element arm.

With only the pair of feed line vias and the pair of arms, a catastrophic common mode develops which severely limits the obtainable bandwidth. In order to suppress this common mode, a structure connects at least the fed arm to the ground with a vertical metalized via or other conductor. Such metalized shorting vias are placed judiciously in the section between the feeding points and the tips of the arm.

The PUMA makes use of multiple dielectric layers both for mechanical support and to electrically enhance the bandwidth and scan performance. This structure allows a completely planar UWB array that requires no external baluns, no 3D machined parts, and can be directly connected to standard RF interfaces. One important aspect of this invention is its modular nature, since this structure could be fabricated in a tiled fashion where each tile includes several elements as shown in FIG. 3. The tiling is a consequence of the absence of electrical connection between two differentially fed element arms.

As it is clear from FIGS. 3 and 4, neighboring elements are capacitively coupled to one another and, as is known in the art, this capacitance is important in achieving wideband performance. The invention allows for many ways to control the amount of capacitive coupling between elements, providing an additional tuning mechanism to control the impedance of the elements. In contrast to UWB array prior art that attempts to increase capacitance across co-polarized arms, in this invention the capacitive coupling must be primarily controlled across orthogonally polarized element arms. Numerous methods of capacitive coupling control will be presented that, among others, include coplanar parasitic capacitors, interdigitations, parasitic plates on a separate dielectric layer, and placing the elements on separate layers.

The dual polarized embodiment of the inventive PUMA, FIG. 4B, consists of two orthogonal pairs of arms arranged in an dual offset periodic lattice, with the four arms (2 arms per polarization) of the array meeting (but not touching) at a central point. The dual offset dual-polarized arrangement is another difference between PUMA and other prior art UWB technologies such as the CSA or FAA, which are based on a coincident phase-center feeding in dual polarization arrangements. This arrangement of the PUMA offers stable and easy to control scan performance.

Figure 2:
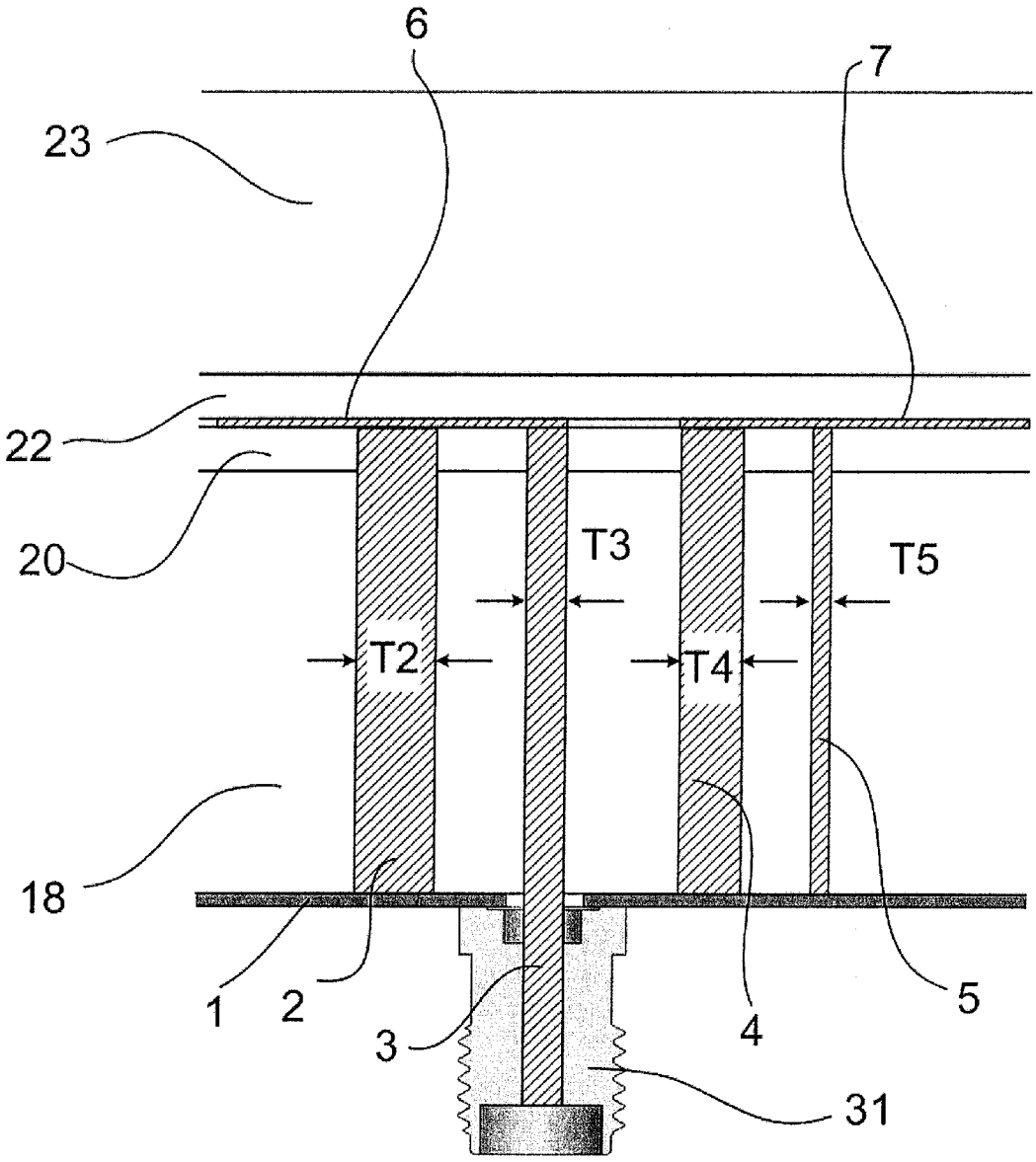
FIG. 2—Cross sectional view of PUMA with four dielectric layers.

A single PUMA element may be comprised of a printed arm 6 and a printed arm 7, located between dielectric layers 20 and 22, shown in FIG. 2. The element layer can be printed directly onto either the top of the dielectric layer 20, which is below the element layer, or to the bottom of dielectric layer 22, which is located above the element layer. There are four metallic vias that extend from the ground plane 1 up to the element layer. The radius of these feed lines can be varied for both tuning and mechanical fabrication purposes. The excitation of each element is carried to the element layer through a pair of metallic vias, 3 and 4. One metallic via 3 extends from beneath the ground plane 1 through a clearance hole in the ground plane 1, up through dielectric layer 18 and connects directly to arm 6 of the element. The connection may be at or near one end of arm 6. The second metallic via 4 (when present) is connected directly to the ground plane 1 on one end, extends up through dielectric layer 18 and is connected directly to arm 7 on the other end. The connection may be at or near one end of arm 7. Together these two lines form a vertically oriented transmission line, which has a characteristic impedance that can be controlled by the thickness and spacing of the vias, as well as the dielectric constant of layer 18. Control of this characteristic impedance plays an important role in the bandwidth and VSWR level of the array. Typically, for a balanced structure such as the two arms 6 and 7, a balanced feed line is required to obtain good performance; indeed, if the element is fed with an unbalanced feed line, such as metallic vias 3 and 4, a common mode develops on the feed line, which causes a catastrophic resonance around midband that dramatically reduces the achievable bandwidth. Other planar technologies therefore rely on balanced feeds that use external baluns or hybrids to obtain wideband performance.

The PUMA elements can be directly fed with an unbalanced line comprised of metallic vias 3 and 4. PUMA 50 has two extra vias 2 and 5 nearby that connect the two element arms to ground plane 1, and act as an integrated balun. One metallic via 2 connects arm 6 directly to the ground plane 1, and a second metallic via 5 connects the other arm 7 directly to the ground plane 1. This structure manages to suppress this common mode, which offers UWB operation for up to 7:1 bandwidth when used with strongly capacitively coupled short element arms.

The position and width of metallic vias 2 and 5 can be used to adjust the onset frequency of the common mode outside of the desired operating band, while minimizing their effects on the wideband impedance matching. Since the feed extending from the ground plane to the element layer is unbalanced, it can be directly connected to an unbalanced feed line such as a standard RF interface (SMA, SMP, GPPO, etc), or can be connected to an integrated backplane with unbalanced planar transmission lines, such as microstrip or stripline. The use of one or more metallic vias such as vias 2 and 5 is a transformative leap over existing technologies, since the conductive connection(s) to ground are involved in the elimination of complex feed organizers and external baluns.

Figure 5:
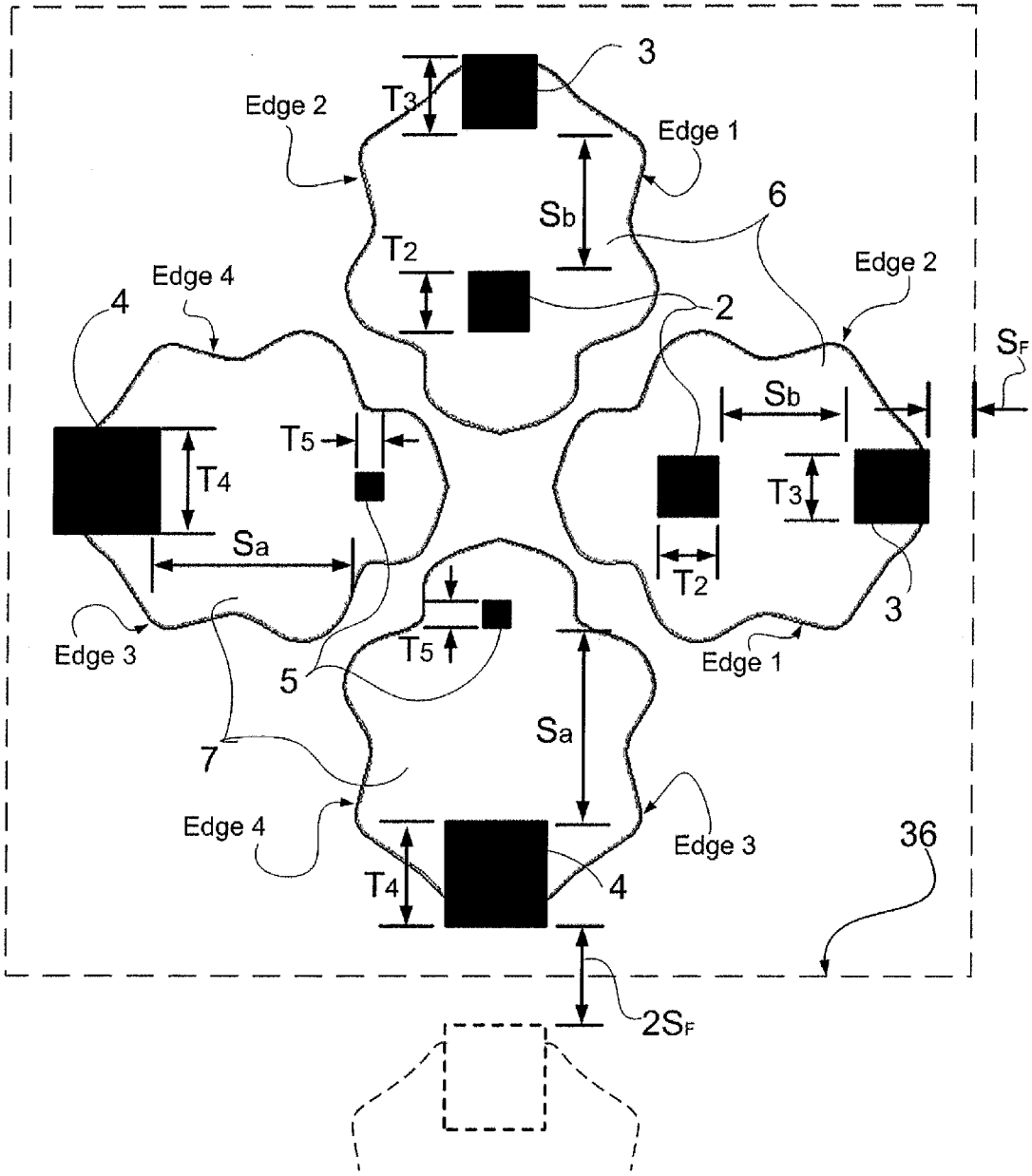
FIG. 5—Top view of a unit cell taken from FIG. 4B, of arbitrarily shaped PUMA elements in a dual polarized dual offset configuration, showing the placement of vertical metallic vias.

The generalized PUMA element shape for an array unit cell is shown in FIG. 5, which in this case places the meeting of the four element arms in the center of the figure, and has the arms of the elements extending towards the feed lines 3 and 4. Feed lines 3 and 4 have a gap between them; in one dimension this gap is created by space $S_F$ between each arm and the edges of the unit cell (edges shown as a dashed line 36). This gap $S_F$ is the gap formed by the spacing of metallic vias 3 and 4, the unbalanced transmission line, and plays a role in the modular fabrication of the array. Because $S_F$ will always be present in any embodiment and it consists of only dielectric material, it could be used as the region where the edge of the array tiles crosses the elements, enabling a tiled modular fabrication and assembly.

Arm 6 has Edge 1 and Edge 2, which are preferably symmetric about a bisecting longitudinal axis, and can take any shape, including taper profiles, linear segments, or any other curve. Arm 7 is defined similarly, with Edge 3 and Edge 4. The edges are preferably mirrored versions of each other in order to reduce high cross-polarization, and later paragraphs describe various preferred embodiments of these edges. The shape of Edges 1, 2, 3 and 4 can be used to adjust the input impedance as seen by the feed line.

Also shown are the size and location of the metallic vias that are connected to the element layer. Metallic vias 3 and 4 are the feed lines, which are connected near one end of each element, although they need not be right at the edge, and have thicknesses $T_3$ and $T_4$ which can also be different sizes. There are additional metallic vias 2 and 5 that connect arms 6 and 7 to the ground plane. Metallic via 2 has a thickness $T_2$ and is separated from metallic via 3 by a distance $S_b$, and metallic via 5 has thickness $T_5$ and is separated from via 4 by $S_a$; all of these parameters may be different from one another, to allow for flexibility in design of the antenna.

Particular Embodiments

The shape of the horizontal arms of the element allows many variations that can be used to alter the electrical performance or allow designs that are easier to fabricate under manufacturing tolerances. Throughout, the elements are typically shown in a dual polarized dual offset lattice, but the element shape and parameters apply to single polarized configurations as well. The various metallization embodiments and dielectric stratifications can be combined judiciously to maximize bandwidth, impedance matching quality in band, and wide angle scanning.

Figure 6:
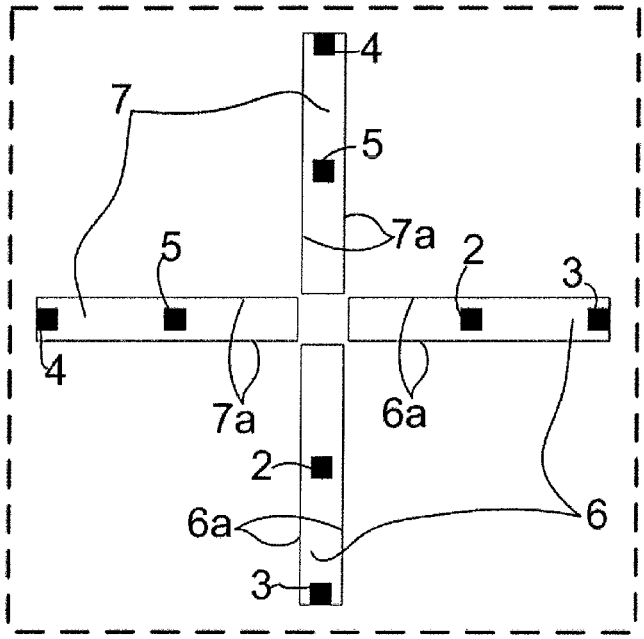
FIG. 6—Top view of dual polarized PUMA unit cell with rectangular arms.

The first embodiment consists of rectangular element arms 6 and 7, shown in FIG. 6. Each arm 6 and 7 has a width that can be varied to affect the impedance of the element, where wider arms lower the resistive component of the input impedance, while narrow arms increase the resistance. The elements all reside on the same layer, and no additional capacitance is required, making this simple to fabricate. This shape is the simplest of the embodiments, and forms a foundation for the following variations.

Figure 7:
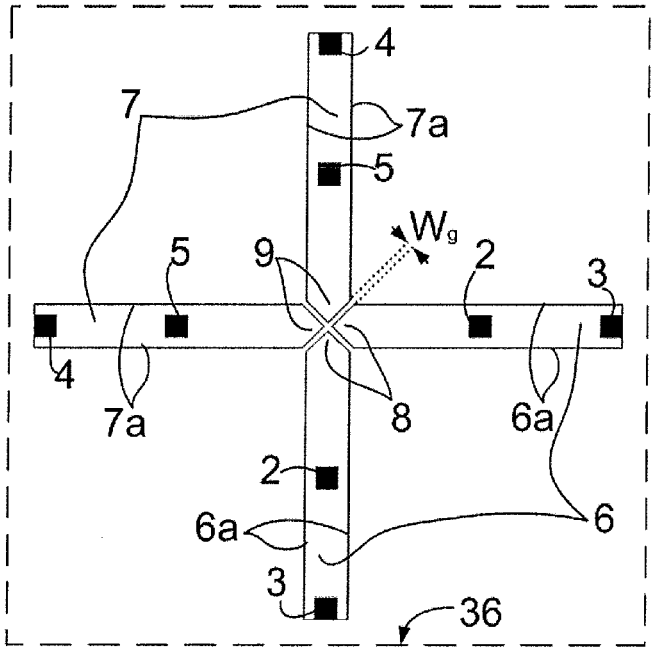
FIG. 7—Top view of dual polarized PUMA unit cell with rectangular arms and tapered ends.

The rectangular arms 6 and 7 shown in FIG. 6 must have a gap in the central space between the ends of the arms, otherwise the arms would overlap. In order to allow higher inter-element capacitance, close spacing between orthogonal neighboring element arms 6 and 7 must be allowed. This can be achieved by forming a triangular tapered section 8 (FIG. 7) connected to the inner ends of arms 6, and similarly a triangular section 9 connected to the inner ends of arms 7. These extra triangles allow the ends of the arms to be placed close together with a separation of $W_g$, which allows much finer control over the amount of capacitance that exists between arms 6 and 7.

Figure 8:
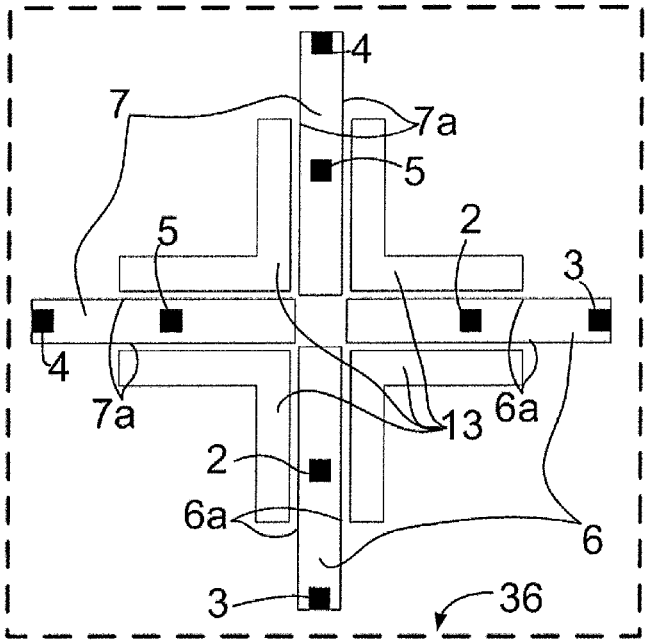
FIG. 8—Top view of dual polarized PUMA unit cell with rectangular arms and coplanar parasitic capacitive plates.

Preliminary studies have shown that the capacitive coupling between orthogonally polarized neighboring elements should be kept greater than that between co-polarized neighboring elements. Following that insight, the third embodiment (FIG. 8) enhances the capacitive coupling between orthogonal arms 6 and 7 through the addition of arbitrarily shaped parasitic capacitive plates 13. The shape of the parasitic plates 13 can take any form. This configuration offers fine control over the coupling between elements in the same polarization and those in orthogonal polarization, since the parasitic plates do not couple elements with the same polarization. These parasitic plates are coplanar with the array elements and therefore are no more difficult to fabricate than the first embodiment, and can be used in combination with the various other embodiments.

Figure 9:
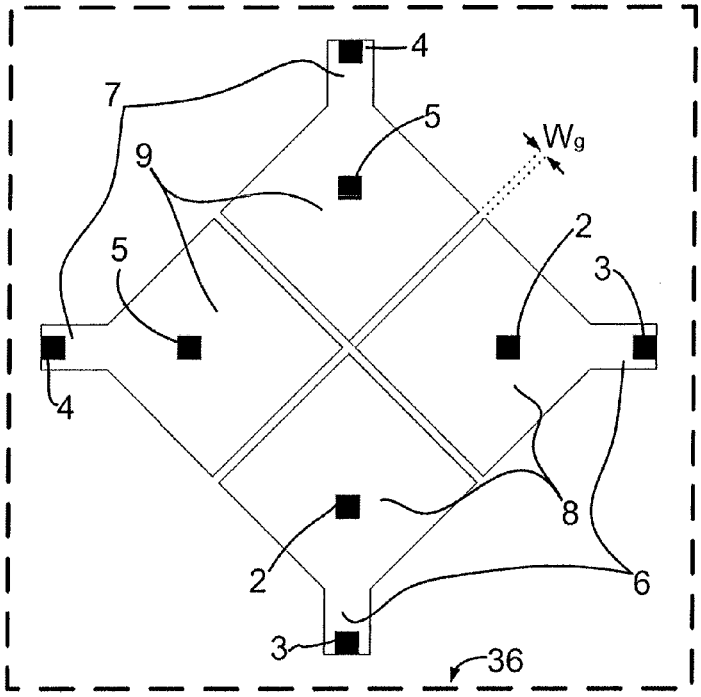
FIG. 9—Top view of dual polarized PUMA unit cell with rectangular arms and diamond shaped patches at the end of each arm.
Figure 10:
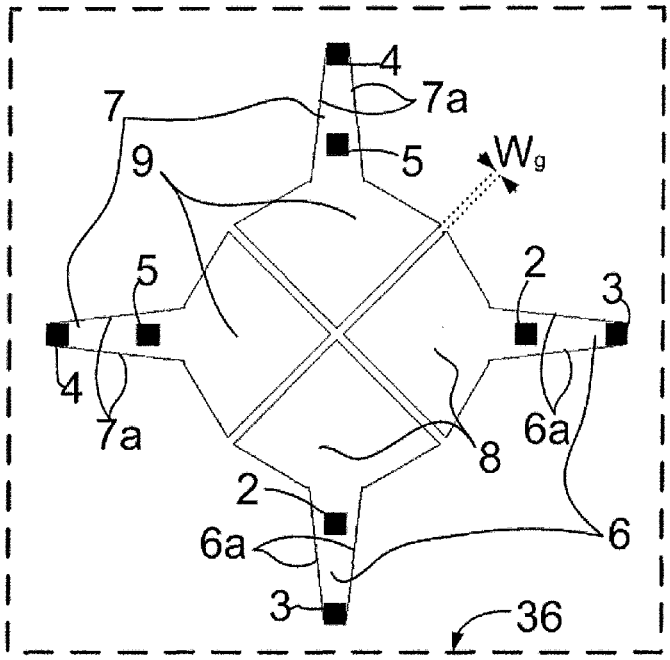
FIG. 10—Top view of dual polarized PUMA unit cell with tapered arms and tapered diamond shaped patch on ends of each arm.
Figure 11:
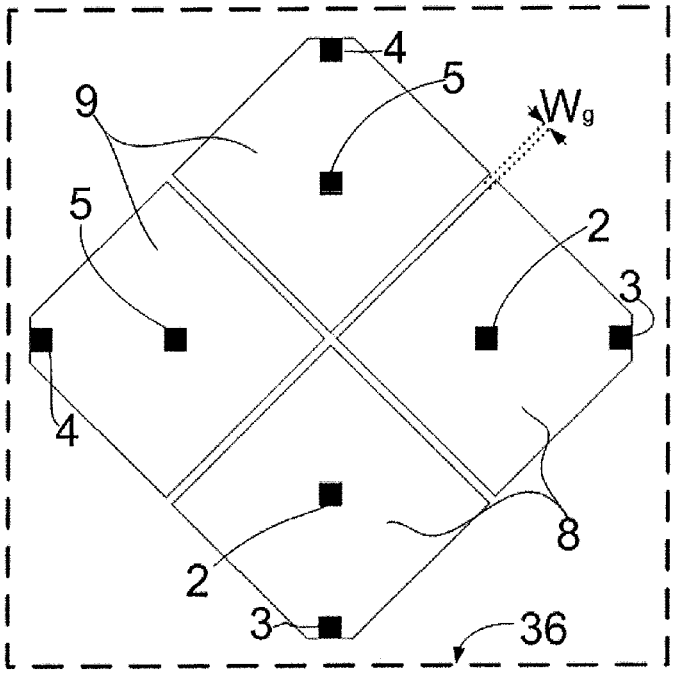
FIG. 11—Top view of dual polarized PUMA unit cell with diamond shaped patch arms.
Figure 12:
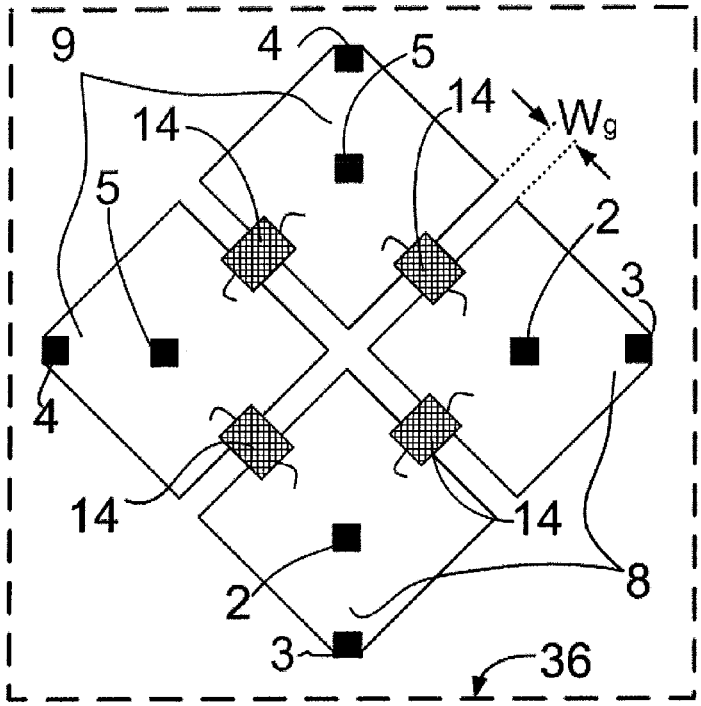
FIG. 12—Top view of dual polarized PUMA unit cell with diamond shaped patch arms with lumped capacitors connected between neighboring elements.

FIG. 9 shows a large diamond shaped section 8 connected to rectangular arm 6, and a large diamond shaped section 9 connected to rectangular arm 7. This shape provides large orthogonal polarization capacitive coupling due to the large length of the metal edge, and also the small size of gap $W_g$, which can be adjusted to tune the strength of the capacitive coupling. A similar shape is shown in FIG. 10, where the combination of arms 6 and 7 with diamond ends 8 and 9 resembles an arrow shape. Edges 7*a* and 6*a* allow a tapered transition from the narrow feed point of the element to the large width of the diamond ends 8 and 9; this taper can take the form of a linear or exponential profile. In addition to the tapering on the arms 6 and 7, the edges of diamond shape 8 and 9 are tapered as well, and can also take on linear or exponential tapers. These tapered edges allow fine control over the impedance of the elements by adjusting the current distribution/paths on the antenna. If the length of arms 6 and 7 are allowed to shrink to zero, the shape shown in FIG. 11 is obtained, with four symmetric diamond shaped arms 6 and 7. This (patch-like) configuration allows for high capacitance and is simple to fabricate since there are no complicated slots to cut or etch into the metal. Also, the most direct method to increase the capacitance is that shown in FIG. 12, which uses lumped capacitors 14 connected between neighboring elements. Any element arm shape can be used with this method. Lumped capacitors can be useful especially for low frequency applications.

The arrangement of the element layers in the dielectric layer stack is adjustable to allow easier fabrication while still achieving good performance. FIG. 2 shows a typical array cross section, with four dielectric layers used to form the array. Layer 18 has a thickness of approximately $\lambda_g/4$ at midband ($\lambda_g$ denoting guided wavelength, $\lambda_g=\lambda_o/\sqrt{\epsilon_r}$, where $\lambda_o$ denotes freespace wavelength), and consists of a material with a relative dielectric constant $\epsilon_r$=1-3. This layer can be made of air, or foam, or honeycomb material or low dielectric constant PTFE materials such as RT/Duroid 5880 or 5880LZ. This layer mechanically supports the upper sections of the array, so it is desirable to have a dielectric layer that has good compression strength and allows vias to be plated through the entire layer. Electrically, layer 18 allows tailoring of the impedance of the volume between the ground plane and the element layer, which is important in tuning the array for optimal bandwidth. Layer 22 and 20 embed the element arms, are approximately $\lambda_g/30$ at midband, have a relative permittivity in the range of $\epsilon_r$=2-4, and at least one layer should be available with a copper cladding which can be etched to form the element layer. Overlying dielectric layer 23 can be used to improve impedance matching and to protect the structure from environmental factors, and typically has a thickness on the order of $\lambda_g/4$ at midband and has relative permittivity values of $\epsilon_r$=1.2-4.

Figure 13:
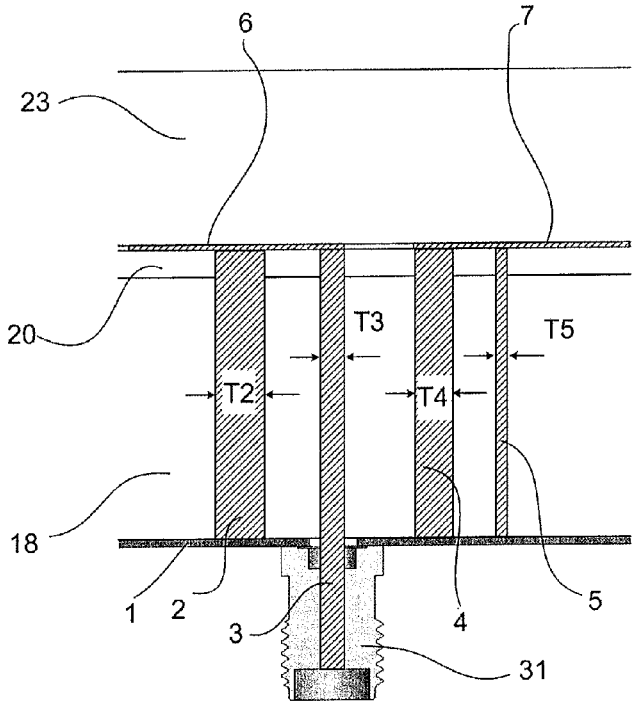
FIG. 13—Cross sectional view of PUMA without the upper element dielectric layer.
Figure 14:
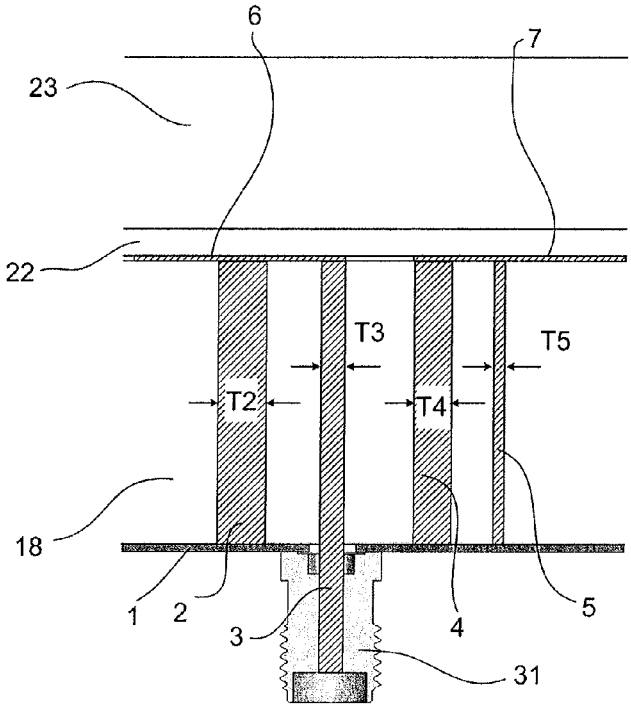
FIG. 14—Cross sectional view of PUMA without the lower element dielectric layer.
Figure 15:
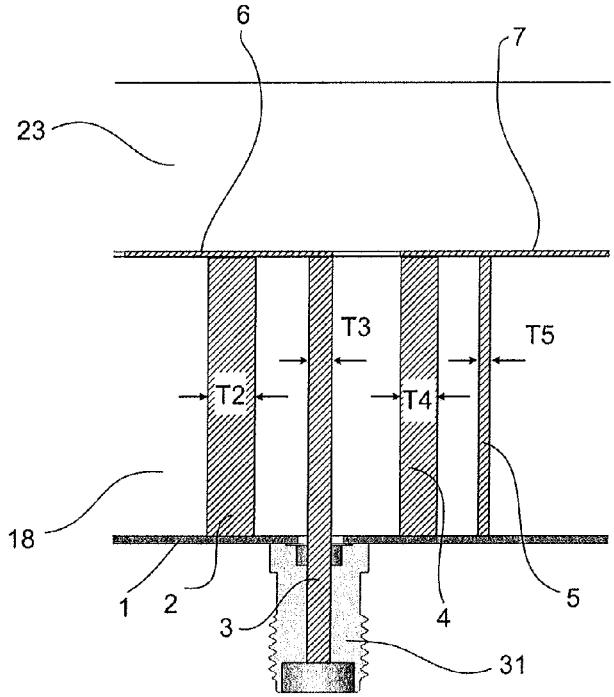
FIG. 15—Cross sectional view of PUMA without either element dielectric layer.
Figure 16:
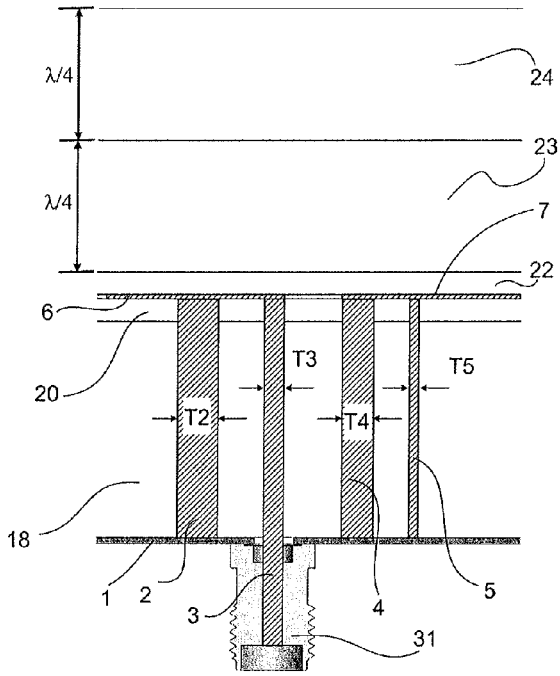
FIG. 16—Cross sectional view of PUMA with a secondary top dielectric layer.

The basic structure shown in FIG. 2 can be modified to that shown in FIG. 13, where dielectric layer 22 has been removed. This can be beneficial for fabrication since the elements can be printed onto the top of layer 20, and then the impedance matching slab 23 can be placed directly onto the element layers, thereby removing the need to bond layers 20 and 22 together with the embedded element layer. FIG. 14 shows the same principle, only with the element layer located between layers 18 and 22; the element layer can be printed either to the bottom of layer 22 or to the top of layer 18. FIG. 15 removes both layers 20 and 22, and instead places the element layer directly between the low permittivity substrate 18 and the impedance matching layer 23, which reduces the number of layers required in the stackup. FIG. 16 shows the typical dielectric stackup shown in FIG. 2, but with a secondary top dielectric layer 24, which is also on the order of $\lambda_g/4$ thickness at midband, and has relative permittivity values of $\epsilon_r$=1.2-2. The top dielectric layer 23 acts like a section of an impedance transformer, so the second layer 24 is analogous to adding a second matching section to an impedance transformer, which can further improve the bandwidth and scan capability of the array. Judicious selection of the layer thicknesses and their relative permittivities is critical in order to avoid scan blindnesses, which can arise due to the surface waves supported by thick dielectric slabs.

Figure 17:
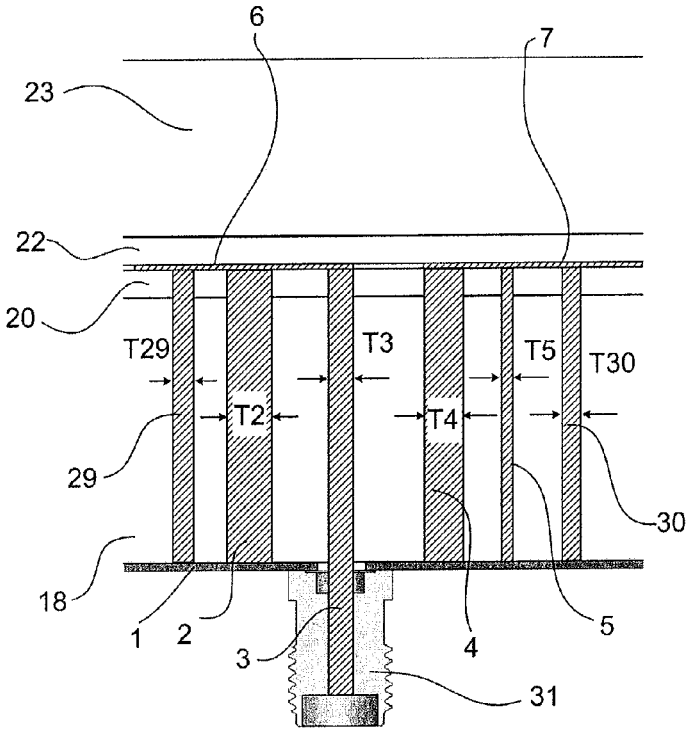
FIG. 17—Cross sectional view of PUMA with multiple vertical metallic vias connecting each element arm to the ground plane.

The next two embodiments involve the plated vias and the feeding, and can be applied to any of the previously described embodiments. FIG. 17 shows a cross-sectional view of a typical PUMA element, with the addition of an arbitrary number of metallic vias (two shown but one, or more than two, can be used) acting as vertical shorts connecting the two element arms 6, 7 to the ground plane 1, from via 2 to via 29, and from via 5 to via 30. The thickness of these vias—$T_2$, $T_5$, $T_{29}$, $T_{30}$—can be adjusted for both electrical tuning and fabrication convenience. These extra vias allow more control in the suppression of the common mode, and also impact the reactance of the antenna, providing an additional means of controlling the impedance of the element. The thickness and spacing between the multiple vias need not be the same on each arm 6 and 7, and the spacing between the vias on a particular arm need not be uniform.

Figure 18:
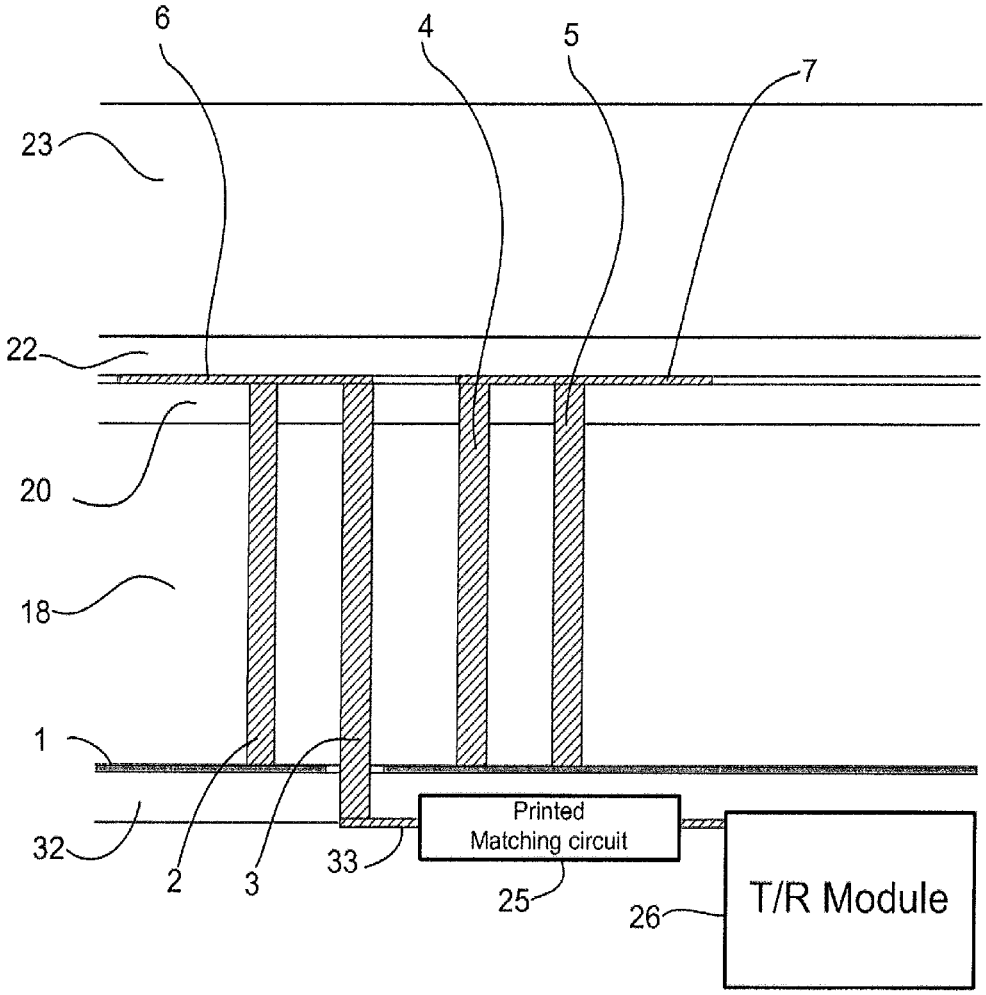
FIG. 18—Cross sectional view of PUMA with microstrip layer on the backplane, used to host a matching network and Transmit/Receive (T/R) modules.

Previously, the element was assumed to be fed by a coaxial connector 31 or coaxial transmission line at the ground plane. Several other unbalanced lines can be used to feed the inventive PUMA array. More importantly, because unbalanced lines such as microstrip can be directly coupled to the inventive PUMA, a printed matching layer can be incorporated on the back side of the array. FIG. 18 shows the array fed with a microstrip line 33 below the ground plane on a backplane dielectric layer 32. This embodiment allows the possibility of using a matching circuit 25 implemented in the planar microstrip that resides within the array unit cell area. FIG. 18 shows a direct conductive connection of the array fed conductor 3 to the matching network 25. This is a possible embodiment, but the direct electrical connection between 3 and 25 is not a necessary condition, because it could be replaced by capacitive coupling, thus eliminating the direct contact. This capacitive coupling approach has the advantage of being simpler to fabricate since the array layers and matching network layers (back-plane) can be fabricated individually and then bonded together. This approach has been used in the preferred embodiment presented in the next section. A direct connection to a planar T/R module 26 could also be possible. This allows the array to be built with a planar feed network directly integrated to the backplane, and the feed line can take the form of any planar microwave unbalanced lines, such as microstrip or stripline. The PUMA has been shown to achieve its best performance when it has an impedance transformer before the antenna, and this provides a convenient and low cost method of implementing the matching network on the backplane.

The next class of embodiments (FIGS. 19-22) is used to improve the capacitive coupling (and consequently the bandwidth and matching level) between orthogonally polarized arms and uses multiple metallization layers. For each of these embodiments, there are many ways to arrange the metallization layers, such as removing one or more of the dielectric layers or printing dipoles onto two sides of a single dielectric layer. As such, each of FIGS. 19-22 shows a top view of the metallization (in the drawing labeled "A"), along with cross sectional views taken along planes highlighted with a dashed line (each of these cross sections is denoted as cross section 1 (labeled "B"), cross section 2 (labeled "C"), and cross section 3 (labeled "D")). Each of the cross sections represents a variation on the vertical stratification of the dielectrics 19, 20, 21 and 22 (additional dielectric layers 19 and 21 maybe be added in some instances due to the use of multiple dipole layers, and they have the same properties of layers 20 and 22). These alternate configurations provide latitude in the fabrication processes used to assemble the metalized layers.

Figure 19:
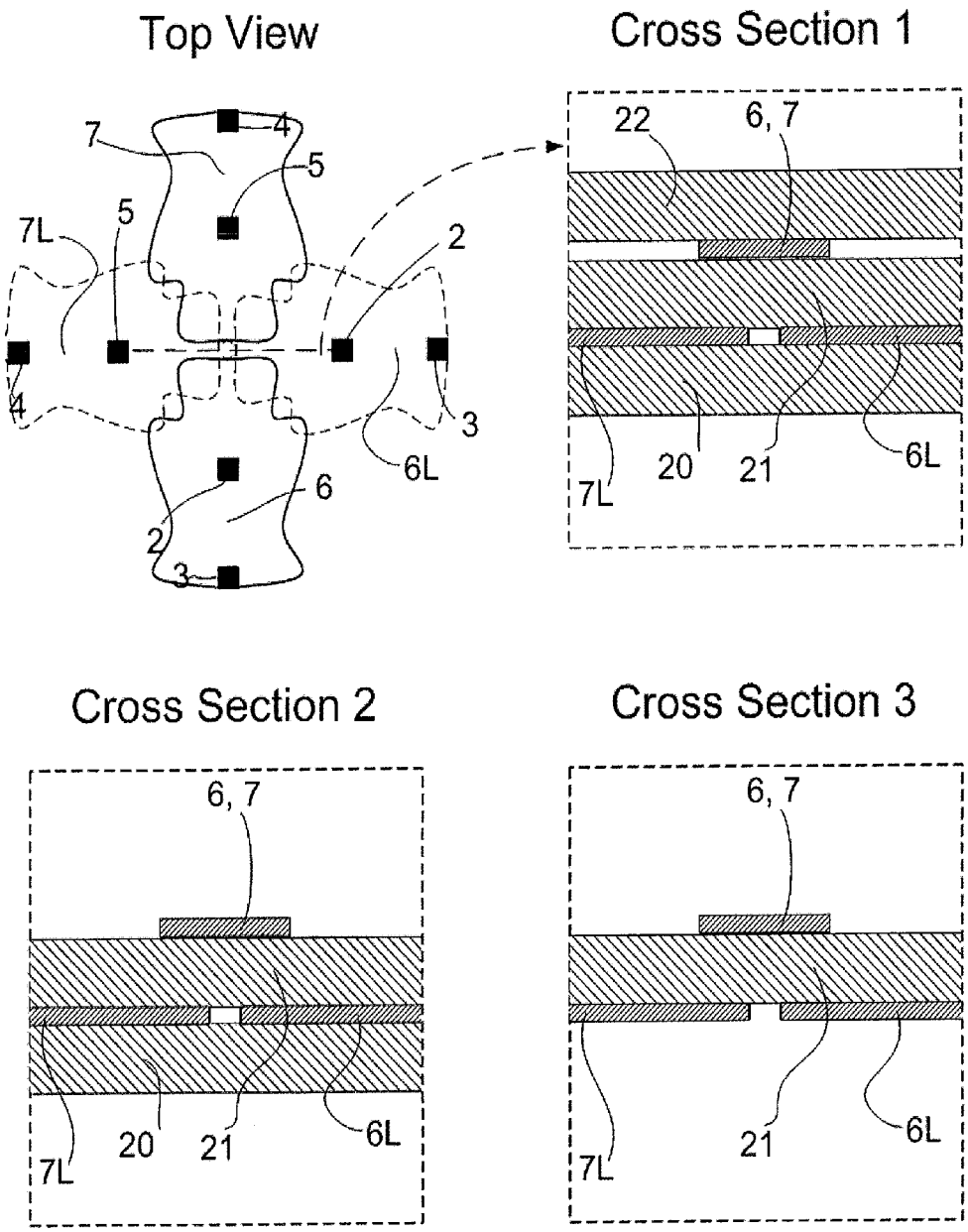
FIG. 19—Capacitive coupling control across PUMA cross-polarized arms by placing the orthogonal polarized arms on a separate metal layer.
Figure 20:
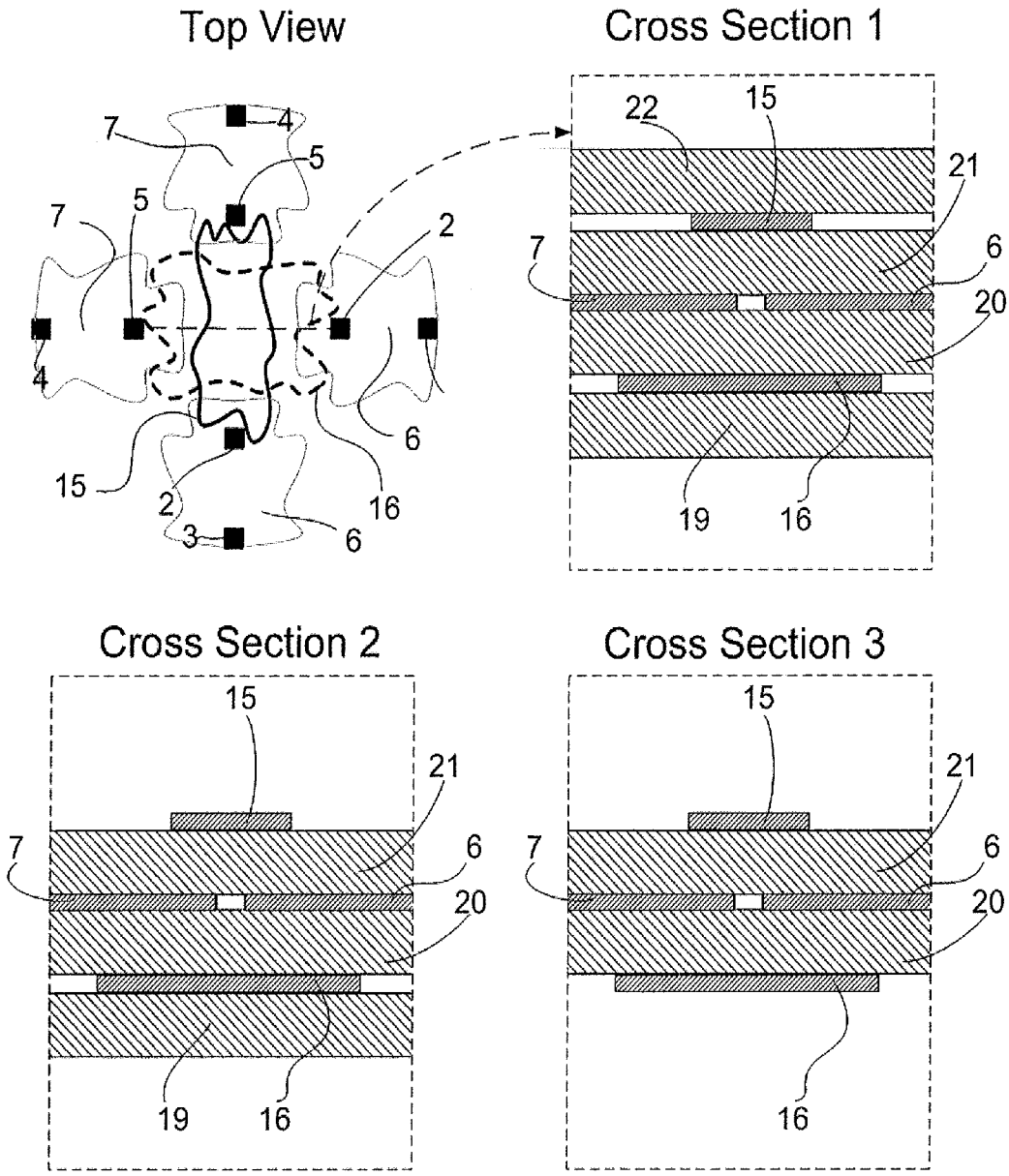
FIG. 20—Capacitive coupling control across PUMA arms with one parasitic capacitor plate above and one parasitic plate below the element layer.
Figure 21:
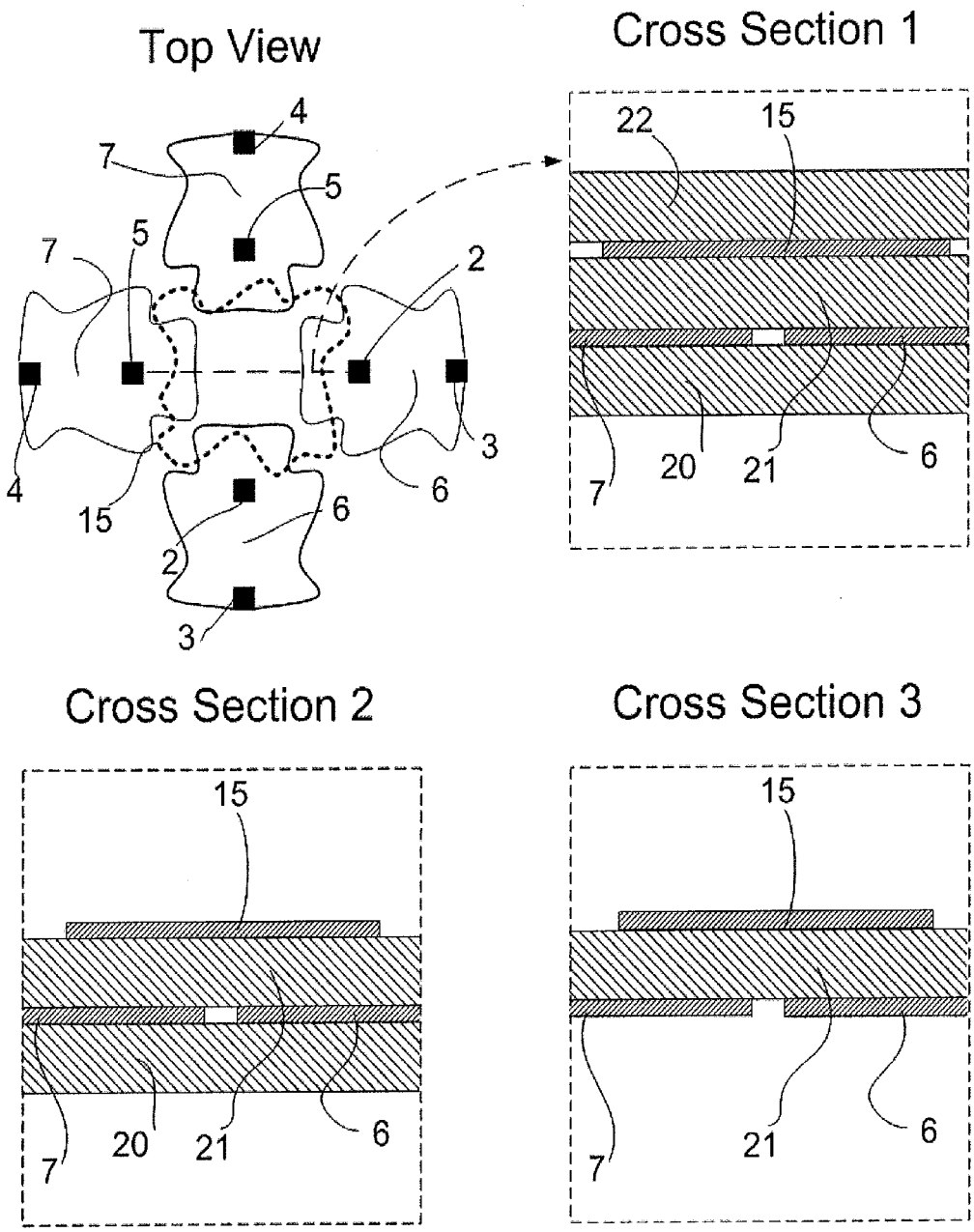
FIG. 21—Capacitive coupling control across PUMA arms of arbitrary shape by placing an arbitrarily shaped parasitic plate above the element layer.
Figure 22:
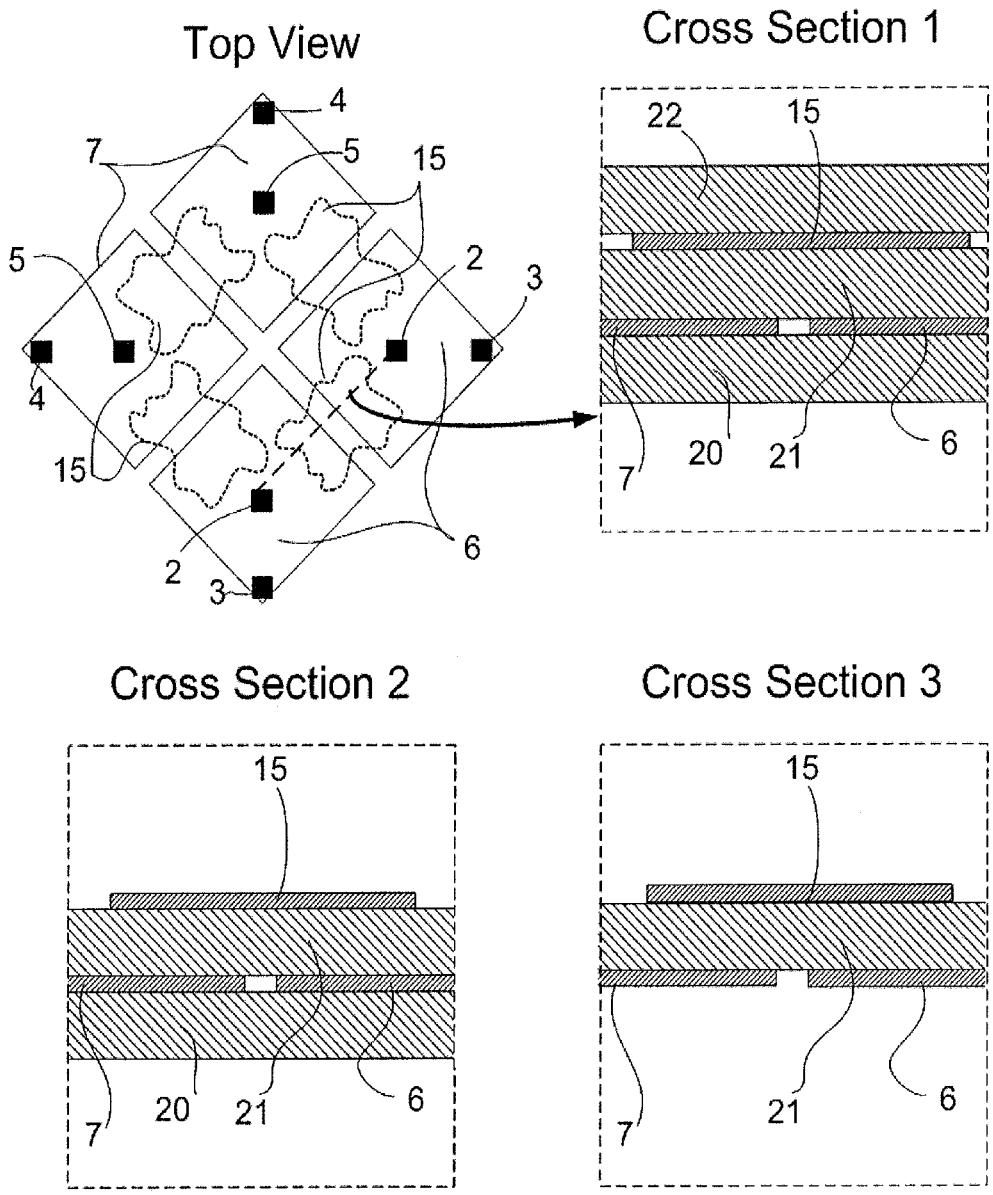
FIG. 22—Capacitive coupling control across diamond shaped PUMA arms with parasitic capacitor plates to couple between elements in different polarizations.

One way to take advantage of two metallization layers is shown in FIG. 19, with the vertical polarization of the arms 6 and 7 printed on a layer above the horizontal polarization, 6L and 7L. By placing the elements on different layers, the orthogonally-polarized arms can overlap, and high orthogonal-pol capacitive coupling can be achieved by controlling the metallization overlap, while the co-pol capacitive coupling can be controlled by the gap between arms/elements in the same polarization. Another embodiment, shown in FIG. 20, arranges elements on one metal layer and adds parasitic plates on additional metal layers to increase the capacitive coupling. In this arrangement one parasitic plate 15 is placed on a layer above the elements, and another parasitic plate 16 is placed on a layer below the elements. This allows the capacitive coupling to be very strong between neighboring elements while still allowing a single layer element printing. Additionally, instead of separate parasitic plates for each polarization, a single parasitic plate 15 can be placed on a separate dielectric layer to couple both elements of the same polarization and also elements in orthogonal polarizations. The parasitic plates can take the form of any arbitrary shape, as shown in FIG. 21. There are many possibilities for the shape of the parasitic capacitor plates, although it is generally preferred that they are symmetric. One particular embodiment could be diamond shaped arms 8 and 9 from FIG. 11 with plates 15 over the diagonally orientated slots between arms 6 and 7, as shown in FIG. 22.

Preferred Embodiment

Figure 23:
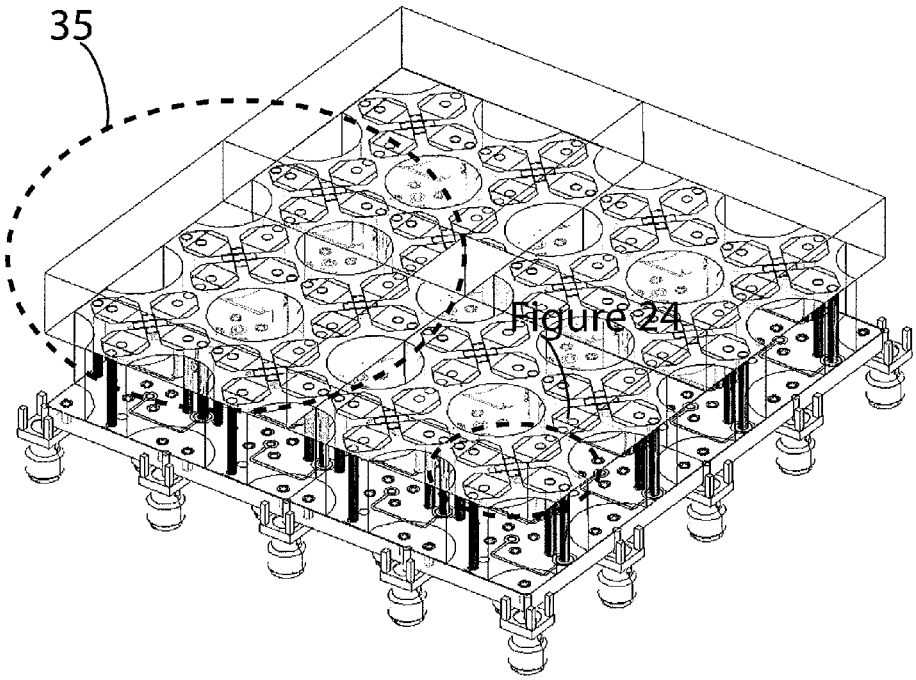
FIG. 23—The preferred embodiment of the PUMA, showing the isometric view of a modular array of four 2×2×2 tiles.
Figure 24:
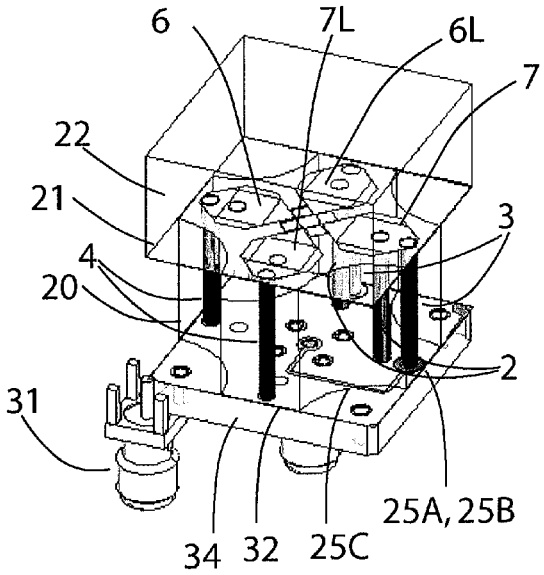
FIG. 24—Close up of the preferred embodiment PUMA unit cell, showing the stackup of dielectric layers, the perforated dielectric layer, the matching network at the bottom of the array and the feeding and shorting metallized vias.
Figure 25:
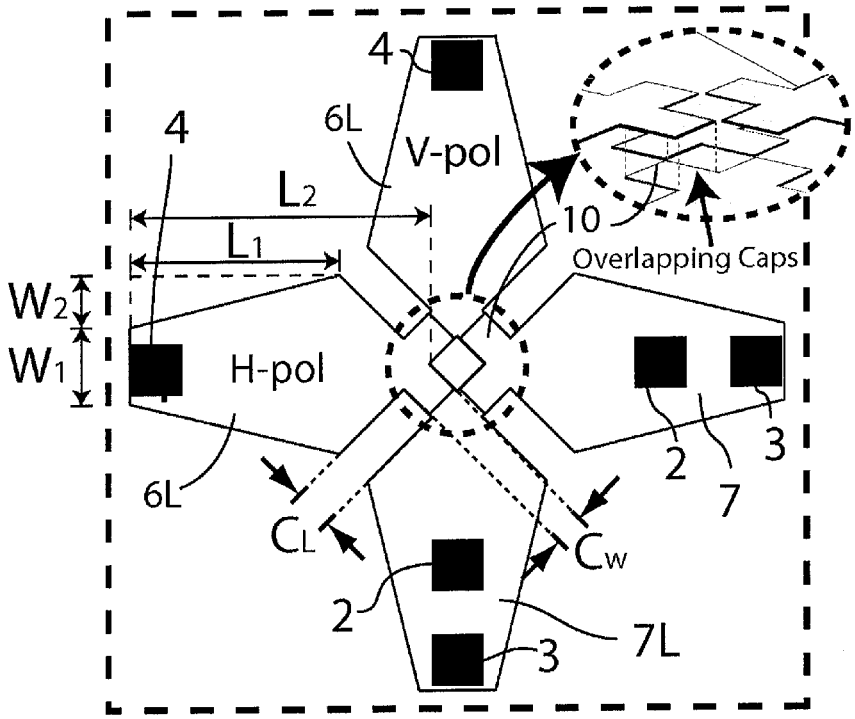
FIG. 25—Top view of a dual-polarized PUMA unit cell of preferred embodiment.

A 4×4 dual-polarized PUMA array is shown in FIG. 23. The figure shows the preferred embodiment and is comprised of four 2×2 modules (tiles) shown in 35. These tiles could be of different size, depending on the manufacturing and assembly process. Each module could be manufactured individually and then assembled together. The assembly does not require electrical connection between elements, but it requires electrical contact at the ground plane layer shown in 20, to maintain a common ground. A close-up isometric view of the preferred PUMA array cell embodiment is shown in FIG. 24. This embodiment is based on the embodiment of FIG. 18, where a matching network is included in the back of the ground plane. The layer arrangement in the region above the ground plane 20 is based on the embodiments described in FIGS. 19A and B. This embodiment uses only one shorting via 2 at each polarization. This helps tuning and improves the low frequency cross-polarization coupling. The shape of the dipole arms is shown in FIG. 25 that depicts a top view of the metallization layers 6, 7 and 6L, 7L. Each element arm is composed of a linearly tapered section that has narrow width close to the feeding vias 3 and 4 that expands to a wide section that turns to a narrowing linear taper at the end of the element. The width, linear opening rates and lengths of these sections are used to tune and optimize performance. Further, each element arm ends at two rectangular conductors that are connected perpendicularly the each linear taper side. The region formed by these rectangular protrusions is shown in 10, and the insert of FIG. 25. These four rectangular conductors form four parallel plate capacitors between orthogonally polarized arms. These capacitors are used to increase the capacitive coupling, thus increasing the bandwidth. The capacitors in 10 should be small in size (small circumference) because otherwise H-plane scan induced resonances could occur in the band. These capacitors could take other shapes, such as being circular instead of rectangular.

The dielectric layer 20 consists of a PTFE type dielectric with low relative dielectric constant (1.94-2.2), and should be able to be drilled and plated. Because this dielectric layer 20 is electrically thick, $\lambda/4$ at the highest frequency, surface wave resonances could occur inside the frequency band at wide scan angles e.g., 45 degrees. To shift these resonances outside of the operating band the dielectric layer 20 is perforated by drilling circular air-filled through-holes in it. The diameter of these holes could be used to control the onset of the surface waves. Different shape perforations could be used, and the perforations could be extended on the other dielectric layers 21 and 22, but in this preferred embodiment they are used only for dielectric layer 20.

Figure 26:
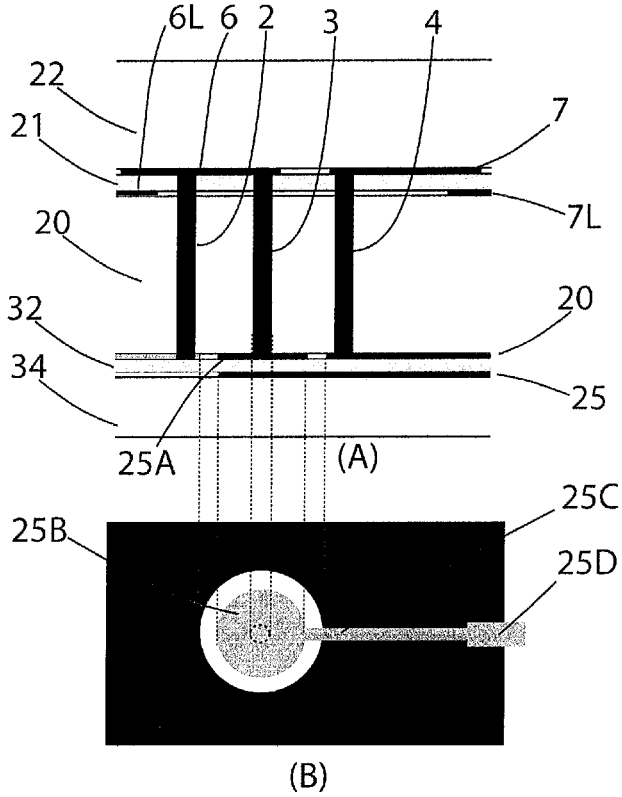
FIG. 26—Cross sectional view of the preferred embodiment, showing the layer stuck-up and the detail of the matching network consisting of a parallel plate capacitor and a quarter wave line.

The matching network 25 is printed at a dielectric layer 34. The thickness and permittivity of the dielectric layer 34 are not critical design parameters, but must be chosen judiciously to minimize radiation losses on the matching network. The matching network is comprised of a capacitor formed by a circular cap 25A at the base of the fed via 3 and a circular conductor 25B. The plates of this capacitor could take other shapes, such as being rectangular. The capacitor is then connected to a quarter wavelength microstrip line transformer 25C, followed by a 50 ohm microstrip line 25D that in turn is connected to a coaxial connector or a Tx/Rx module. The microstrip lines use metallization layer 20 as a ground conductor. The separation and dielectric constant of the material between the metallization layer 25 and the ground layer 20 are important design parameters for the matching network. Dielectric layer 32 could be a thin PTFE dielectric layer or a thick bonding layer. The overall thickness of layer 32 should not exceed 5 mils. A cross sectional view of the unit cell is shown in FIG. 26(A), and a bottom view of the back side of the array (matching network) is shown in FIG. 26(B).

Figure 27:
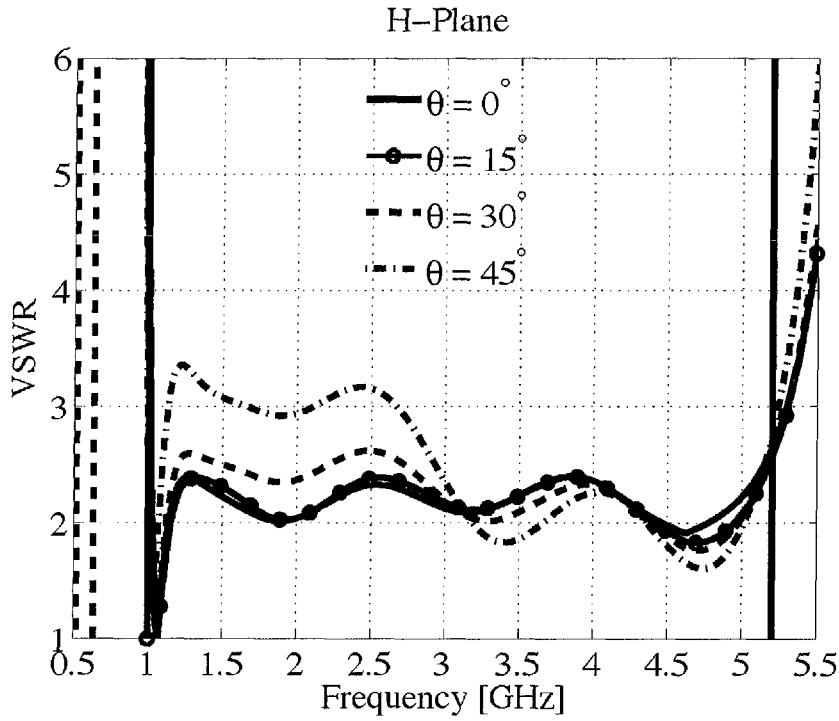
FIG. 27—Graph of VSWR (referenced to 50Ω) for various scan angles in the H-plane. The results represent an infinite array of the preferred embodiment.

The preferred embodiment infinite array performance was evaluated using various commercial electromagnetic simulation software, which are considered industry standard and are well validated. The results the preferred PUMA embodiment are presented for broadside and scanning in the H-plane. FIG. 27 shows the VSWR referred to 50Ω. The figure shows four curves for the different scan angles in the H-plane. The broadside curve is represented with solid line and produces VSWR that is less than 2.4 in the band from 1-5.25 GHz. The same behavior is observed for the scan angles less than 30 degrees. The 45 degrees dashed-dot curve shows an increase of the VSWR at low frequencies, something that is typical on broadband arrays. Similar performance was observed in the E- and D-plane scanning.

Other embodiments will occur to those skilled in the art and are within the scope of the claims.

What is claimed is:

1. A planar ultrawideband modular antenna for connection to a two-lead unbalanced feed line comprising an excited feed line and a grounded feed line, the antenna comprising:

a ground plane;

an antenna element spaced from the ground plane and comprising a planar fed conductive arm electrically coupled to the excited feed line, and a planar grounded conductive arm directly electrically coupled by the grounded feed line to the ground plane;

one or more first conductors spaced from the excited feed line and electrically connecting the fed arm to the ground plane; and one or more second conductors spaced from the grounded feed line and electrically connecting the grounded arm to the ground plane.

2. The planar ultrawideband modular antenna of claim 1 in which the arms are coplanar and comprise conductors on a surface of a dielectric.

3. The planar ultrawideband modular antenna of claim 2 in which the first conductors and the second conductors each comprise vias passing through the dielectric.

4. The planar ultrawideband modular antenna of claim 3 comprising two or more first conductor vias for the fed arm and one or more second conductor vias for the grounded arm.

5. The planar ultrawideband modular antenna of claim 1 in which the arms lie along a single longitudinal axis.

6. An antenna cell comprising two antennas of claim 5, in which the longitudinal axes of the arms of the two antennas are orthogonal.

7. The antenna cell of claim 6 in which the arms of the two antennas are co-planar.

8. The antenna cell of claim 6 in which the arms of the two antennas are located in different planes.

9. The antenna cell of claim 6 further comprising one or more planar metallic elements spaced from the arms to improve capacitive coupling between orthogonally polarized arms.

10. A planar ultrawideband modular array antenna comprising a plurality of antenna cells of claim 6.

11. The planar ultrawideband modular array antenna of claim 10 in which the antenna elements of each cell are arranged in a dual offset configuration wherein the two arms of one element lie along a first longitudinal axis and the two arms of a second element lie along a second longitudinal axis that is perpendicular to the first longitudinal axis.

12. The planar ultrawideband modular array antenna of claim 10 further comprising one or more dielectric layers on top of the elements.

13. The planar ultrawideband modular array antenna of claim 12 in which the thickness of the array is approximately equal to one-third of the mid-band free space wavelength of the feed.

14. The planar ultrawideband modular antenna of claim 1 in which the fed arm is coupled to the feed network by a feed line that passes to or through the ground plane without touching it and is connected to the fed arm at a feed point, and a grounding conductor connected between the ground plane and the grounded arm at a grounding point.

15. The planar ultrawideband modular antenna of claim 14 in which the feed point and the grounding point are at or proximate one end of the arms.

16. The planar ultrawideband modular antenna of claim 15 in which the first conductor is located between the feed point and the other end of the fed arm.

17. The planar ultrawideband modular antenna of claim 16 in which the arms have the same shape, the shape being substantially rectangular proximate the feed and grounding points.

18. The planar ultrawideband modular antenna of claim 17 in which the substantially rectangular shape is linearly tapered, and is most narrow proximate the feed and grounding points.

19. The planar ultrawideband modular antenna of claim 18 in which the ends of the arms most distant from the feed and grounding points define a narrowing linear taper.

20. The planar ultrawideband modular antenna of claim 19 further comprising a capacitive region at the ends of the arms farthest from the feed and grounding points.

21. The planar ultrawideband modular antenna of claim 20 in which the capacitive region comprises two rectangular conductors, one connected perpendicularly to each side of the narrowing linear taper.

22. The planar ultrawideband modular antenna of claim 14 in which the feed line is coupled to a matching network that comprises a capacitor.

23. The planar ultrawideband modular antenna of claim 22 in which the capacitor comprises parallel conductive plates.

24. The planar ultrawideband modular antenna of claim 23 in which the matching network further comprises a microstrip line quarter wavelength transformer connected to the capacitor.

25. The planar ultrawideband modular antenna of claim 24 in which one of the plates of the capacitor, and the microstrip line, are located in a plane that is parallel to the ground plane.

26. The planar ultrawideband modular antenna of claim 1 in which the arms are separated from the ground plane by one or more layers of dielectric, and wherein one or more such dielectric layers are perforated through their thickness.

27. The planar ultrawideband modular antenna of claim 8 in which the arms all radiate from a central region and at the central region together define overlapping parallel plate capacitors.

28. A planar ultrawideband modular array antenna cell for connection to a feed network, comprising:

a ground plane;

two antennas, each antenna comprising a fed arm and a grounded arm that are co-planar, the arms comprising conductors on a surface of a dielectric, in which the arms of each antenna lie along a single longitudinal axis, and in which the longitudinal axes of the arms of the two antennas are orthogonal and lie in parallel planes, in which the fed arm of each antenna is capacitively coupled to the feed network and the grounded arm of each antenna is directly electrically coupled to the ground plane, in which the arms are arranged in a dual offset configuration;

one or more conductive vias through the dielectric that electrically connect the fed arm to the ground plane;

one or more dielectric layers on top of the elements, in which the thickness of the array is approximately equal to one-third of the mid-band free space wavelength of the feed;

wherein the fed arm is coupled to the feed network by a feed line that passes to or through the ground plane without touching it and is connected to the fed arm at a feed point, and a grounding conductor connected between the ground plane and the grounded arm at a grounding point, in which the feed point and the grounding point are at or proximate one end of the arms, in which the conductive via is located between the feed point and the other end of the fed arm, and in which the arms have the same shape, the shape being substantially rectangular proximate the feed and grounding points and further comprise a capacitive region at the ends of the arms furthest from the feed and grounding points, the capacitive region defined by parallel conductive plates;

in which the feed line is coupled to a matching network that comprises a capacitor that comprises parallel conductive plates, in which the matching network further comprises a microstrip line quarter wavelength transformer connected to the capacitor, and in which one of the plates of the capacitor, and the microstrip line, are located in a plane that is parallel to the ground plane; and wherein the arms are separated from the ground plane by one or more layers of dielectric, and wherein one or more such dielectric layers are perforated through their thickness.

29. A planar ultrawideband modular array antenna comprising a plurality of cells of claim 28.

* * * * *